US012448770B2

(12) United States Patent
DiCristofaro

(10) Patent No.: US 12,448,770 B2
(45) Date of Patent: Oct. 21, 2025

(54) COMPOUND STRUCTURES WITH SCALABLE INTERIOR ROOM SIZES USING MODULAR UNITS TO FORM MOBILE, SEMI-PERMANENT AND PERMANENT STRUCTURES

(71) Applicant: FERO INTERNATIONAL INC., Stoney Creek (CA)

(72) Inventor: Vincenzo DiCristofaro, Burlington (CA)

(73) Assignee: FERO INTERNATIONAL INC., Stoney Creek (CA)

( * ) Notice: Subject to any disclaimer, the term of this patent is extended or adjusted under 35 U.S.C. 154(b) by 222 days.

(21) Appl. No.: 18/124,064

(22) Filed: Mar. 21, 2023

(65) Prior Publication Data

US 2023/0323653 A1 Oct. 12, 2023

Related U.S. Application Data

(63) Continuation of application No. PCT/CA2021/051323, filed on Sep. 22, 2021.

(60) Provisional application No. 63/082,347, filed on Sep. 23, 2020, provisional application No. 63/081,909, filed on Sep. 22, 2020.

(30) Foreign Application Priority Data

Jul. 23, 2021 (WO) ..... PCT/CA2021/051031

(51) Int. Cl.
*E04B 1/348* (2006.01)

(52) U.S. Cl.
CPC ..... *E04B 1/3483* (2013.01); *E04B 1/34869* (2013.01)

(58) Field of Classification Search
CPC ..... E04B 1/3483; E04B 1/348; E04B 1/34869
USPC ..... 52/79.1
See application file for complete search history.

(56) References Cited

U.S. PATENT DOCUMENTS 2,795,014 A 6/1957 Kelly
3,022,869 A 2/1962 Radek
3,766,844 A 10/1973 Donnelly et al.
(Continued)

FOREIGN PATENT DOCUMENTS

CA 2245624 A1 2/2000
CA 2486205 A1 12/2003
(Continued)

OTHER PUBLICATIONS

International Search Report and Written Opinion mailed Oct. 6, 2021 in International Patent Application No. PCT/CA2021/051031 (15 pages).

(Continued)

*Primary Examiner* — Paola Agudelo
(74) *Attorney, Agent, or Firm* — SMART & BIGGAR LP; Tonino Rosario Orsi; Christopher Kowal

(57) ABSTRACT

Various embodiments are described herein for mobile units having an interior defined by fewer than four side walls, the mobile units being adapted to be interconnected with at least one like or different mobile unit, the at least one like or different mobile unit having fewer than four side walls, thereby to jointly form a large interior room with a longitudinal support structure for the roof structure of at least one of the mobile units.

19 Claims, 16 Drawing Sheets

(56) References Cited

U.S. PATENT DOCUMENTS

| | | | | |
|---|---|---|---|---|
| 4,833,841 | A * | 5/1989 | Ellington, III | E04B 1/3483 52/690 |
| 6,591,558 | B1 | 7/2003 | De Zen | |
| 8,322,086 | B2 * | 12/2012 | Weber | E04B 1/18 52/234 |
| 9,631,365 | B2 | 4/2017 | Bottin et al. | |
| 10,196,809 | B2 * | 2/2019 | Hall | B32B 27/065 |
| 10,293,591 | B2 | 5/2019 | Nielsen-Cole et al. | |
| 10,492,970 | B2 | 12/2019 | Merino et al. | |
| 10,557,262 | B2 | 2/2020 | Moran et al. | |
| 2007/0271857 | A1 | 11/2007 | Heather et al. | |
| 2011/0232543 | A1 | 9/2011 | Burroughs et al. | |
| 2012/0077429 | A1 * | 3/2012 | Wernimont | F24F 3/167 52/302.1 |
| 2012/0160854 | A1 * | 6/2012 | Defoe | F16J 15/14 277/316 |
| 2012/0279141 | A1 * | 11/2012 | Wiederick | E04H 5/02 52/79.5 |
| 2015/0101264 | A1 | 4/2015 | Jornitz | |
| 2016/0010884 | A1 | 1/2016 | Holtz et al. | |
| 2018/0195266 | A1 | 7/2018 | Arakane et al. | |
| 2021/0047828 | A1 * | 2/2021 | Williams | E04H 5/02 |
| 2022/0025663 | A1 * | 1/2022 | Heitsman | E04B 1/34838 |
| 2022/0064935 | A1 * | 3/2022 | Williams | E04B 1/34846 |
| 2023/0145279 | A1 * | 5/2023 | Snorrason | E04B 1/34861 52/79.1 |
| 2023/0304278 | A1 | 9/2023 | Dicristofaro | |

FOREIGN PATENT DOCUMENTS

| | | | |
|---|---|---|---|
| CA | 2954904 | A1 | 1/2016 |
| CN | 110141441 | A | 8/2019 |
| DE | 4230357 | A1 | 3/1994 |
| KR | 101471039 | B1 | 12/2014 |
| KR | 101644921 | B1 | 8/2016 |
| KR | 101646524 | B1 | 8/2016 |
| WO | 2014056549 | A1 | 4/2014 |
| WO | 2022016291 | A1 | 1/2022 |
| WO | 2022061458 | A1 | 3/2022 |

OTHER PUBLICATIONS

International Search Report and Written Opinion mailed May 1, 2023 in International Patent Application No. PCT/CA2023/050106 (10 pages).

International Search Report and Written Opinion mailed Nov. 30, 2021 in International Patent Application No. PCT/CA2021/051323 (13 pages).

Extended European Search Report dated Jul. 24, 2024 in European Patent Application No. 21847243.9 (9 pages).

* cited by examiner

Example School
Site Render

COMPOUND STRUCTURES WITH SCALABLE INTERIOR ROOM SIZES USING MODULAR UNITS TO FORM MOBILE, SEMI-PERMANENT AND PERMANENT STRUCTURES

CROSS REFERENCE TO RELATED APPLICATIONS

This application is a continuation of PCT/CA2021/051323 filed on Sep. 22, 2021, which claims the benefit of U.S. Provisional Patent Application No. 63/081,909 filed on Sep. 22, 2020, and U.S. Provisional Patent Application No. 63/082,347 filed on Sep. 23, 2020, and also claims foreign priority to PCT Patent Application No. PCT/CA2021/051031 filed on Jul. 23, 2021. The contents of United Provisional Patent Application No. 63/081,909, U.S. Provisional Patent Application No. 63/082,347, PCT Patent Application No. PCT/CA2021/051031 and PCT Patent Application No. PCT/CA2021/051323 are each hereby incorporated by reference in their entirety.

FIELD

Various embodiments are described herein that relate generally to various aspects of portable, permanent and/or semi-permanent structures including, but not limited to, shipping containers, and various types of dwellings including medical units such as, but not limited to, medical rooms, portable intensive care units (ICUs), operating rooms (ORs), step down or isolation rooms, long-term care units, other segregated isolation chambers, and systems thereof as well as for non-medical units and non-medical uses such as classrooms.

BACKGROUND

The following paragraphs are provided by way of background to the present disclosure. They are not, however, an admission that anything discussed therein is prior art or part of the knowledge of persons skilled in the art.

Portable structural units can be helpful in providing temporary structures during times of need. For example, when the portable structural unit is a mobile medical unit such as, but not limited to, mobile intensive care units (ICUs) or operating rooms (ORs), such mobile structures can be useful for field medical operations, and for expanding the capacity of a permanent hospital location to enable health care workers to respond to unplanned increases in patient loads.

However, various practical matters are not addressed in the prior art for certain portable, semi-permanent and permanent structures. For example, while these conventional portable structures are promoted for being rapidly deployable, this appears to stem solely from the fact that they are portable, and they may not be versatile for use in different situations. However, some of these structures do not include airflow systems or if they do include airflow systems, they are rudimentary and are not versatile.

Furthermore, the prior art does not disclose any formats, techniques or materials that are for maximizing the amount of interior volume that is usable for personnel, beds, air handling, medical equipment and utilities when the space is somewhat limited in a portable or semi-permanent structure. Existing standard interior wall construction materials and techniques that are in common use for larger spaces reduce in greater proportion the usable interior volume in smaller spaces.

SUMMARY

Disclosed here are generally various configurations of portable modular units including semi-permanent units, and various aspects of physical, electrical and/or communications interconnections between the different portable units in such a system. In another aspect, certain embodiments describe various techniques and materials usable for construction of the portable units. Some of the teachings herein are also applicable to permanent structures. Examples of portable, semi-permanent and permanent structures to which at least some of the teachings herein pertain include various structures such as, but not limited to, shipping containers and various types of dwellings including medical units such as, but not limited to, portable intensive care units (ICUs), operating rooms (ORs), step down or isolation rooms, long-term care units, and other segregated isolation chambers, as well as non-medical uses.

In one broad aspect, in accordance with the teachings herein, there is provided at least one embodiment of a compound structure comprising: a first mobile unit including: a first floor structure; a first roof structure; at least one first side wall that is coupled to the floor structure and the roof structure to define a first open side for the first mobile unit; a second mobile unit including: a second floor structure; a second roof structure; at least one second side wall that is coupled to the floor structure and the roof structure to define a second open side for the second mobile unit; and a support structure that is adapted to couple the first and second roof structures together to releasably connect the first and second mobile units so that the first open side of the first mobile unit faces the second open side of the second mobile unit when the first mobile unit and the second mobile unit are assembled adjacent to one another in the compound structure.

In at least one embodiment, the support structure is a roof support that is connected to the roof structure of at least one of the first or second mobile unit.

In at least one embodiment, the support structure is attached along a longitudinal portion of an exterior of at least one of the first and second mobile units.

In at least one embodiment, the support structure is attached along a longitudinal portion of an interior portion of the at least one of the first and second mobile units.

In at least one embodiment, the support structure is attached along a longitudinal portion to the roof structure of at least one of the first and second mobile units so that an upper portion of the support structure extends along an exterior of the roof structure of at least one of the first and second mobile units and a second portion of the support structure extends along a longitudinal portion of an interior portion of at least one of the first and second mobile units.

In at least one embodiment, the interior portion of at least one of the first and second mobile units is a longitudinal portion of the ceiling structure of at least one of the first and second mobile units.

In at least one embodiment, the support structure is attached along a portion of the first and second roof structures that are adjacent to one another when the first and second mobile units are assembled adjacent to one another in the compound structure.

In at least one embodiment, the support structure extends along a substantial portion of the longitudinal extent of the first and second mobile structures.

In at least one embodiment, the first and second open sides extend along only a section of the longitudinal extent of the first and second mobile units and the support structure extends to cover the section and has a length that is shorter than a length of the first and second mobile units.

In at least one embodiment, the support structure comprises a single truss.

In at least one embodiment, the support structure comprises a first truss and a second truss that are releasably coupled to one another where the first truss is attached to the first mobile unit and the second truss is attached to the second mobile unit.

In at least one embodiment, a given mobile unit comprises two or more support structures that are attached along a longitudinal extent of the given mobile unit.

In at least one embodiment, the support structure comprises two edge trusses that are located along opposite longitudinal edges of the given mobile unit.

In at least one embodiment, the given mobile unit comprises two opposing open sides that are located along portions of the longitudinal extent the given mobile unit.

In at least one embodiment, the support structure comprises additional trusses that extend longitudinally and are arranged between the two edge trusses.

In at least one embodiment, the compound structure further comprises a seal between edges of the first and second roof structures of the first and second mobile units that are adjacent to one another.

In at least one embodiment, the seal comprises a gasket.

In at least one embodiment, the seal comprises neoprene rubber foam, a closed cell foam or a combination thereof.

In at least one embodiment, the compound structure further comprises one or more bridge plates that are installed to cover longitudinal edge portions of the first and second floor structures that are adjacent to one another.

In at least one embodiment, the compound structure further comprises an insulation region that is below the one or more bridge plates and between longitudinal edge portions of the first and second floor structures.

In at least one embodiment, at least one of the mobile units includes an air flow system for providing conditioned air into the compound structure, where the air flow system includes components located in a maintenance room at one or both ends of the at least one mobile unit.

In at least one embodiment, at least one of the mobile units is made from a shipping container or a custom enclosure.

In at least one embodiment, the mobile units each include a vertical half wall portion that are adjacent to one another and fastened together.

In at least one embodiment, the compound structure is used as an educational structure including a classroom and/or a portable, a military structure, a correctional facility, a penitentiary structure, a testing and vaccination centre, a quarantine facility, a modular laboratory structure, a cleanroom, a long-term care facility, a natural disaster safe shelter, an indigenous community housing structure, a vertical farming structure, a grow room, a mobile restaurant, a mobile bar, a cottage, a retail structure, a mining structure, a modular housing structure, a social housing structure or a remote community structure.

In another aspect, in accordance with the teachings herein, there is provided in at least one embodiment a mobile unit comprising: a floor structure; a roof structure; at least one side wall that is coupled to the floor structure and the roof structure to define at least one open side for the mobile unit; and a support structure that is coupled to the roof and adapted to be releasably connected to an additional mobile unit having an additional open side that faces the open side of the mobile unit when the mobile unit and the additional mobile unit are assembled.

In at least one embodiment, the support structure is attached along a longitudinal extent of an exterior portion of the roof of the mobile unit.

In at least one embodiment, the support structure is inside the mobile unit and is attached along a longitudinal extent of a portion of a ceiling of the mobile unit.

In at least one embodiment, the support structure is attached to the roof structure of the mobile unit so that an upper portion of the support structure extends above the roof structure and a second portion of the support structure extends below the roof structure into an interior of the mobile unit.

In at least one embodiment, the support structure is attached along a portion of the roof structure that is adjacent to the at least one open side of the mobile unit.

In at least one embodiment, the support structure comprises a single truss.

In at least one embodiment, the support structure comprises two edge trusses that are located along both longitudinal edges of the mobile unit.

In at least one embodiment, the mobile unit comprises two opposing open sides that are each covered by one of the two edge trusses.

In at least one embodiment, the support structure comprises at least one additional truss that is attached along a longitudinal extent of the mobile unit between the two edge trusses.

In at least one embodiment, the mobile unit further comprises an air flow system for providing conditioned air into an interior of the mobile unit, where the air flow system includes components located in a maintenance room at one or both ends of the mobile unit.

In at least one embodiment, the mobile unit is made from a shipping container or a custom enclosure.

In at least one embodiment, the mobile unit has less than four side walls that define a first interior and is adapted to be interconnected with at least one other similar or different mobile unit having less than four side walls that define a second interior, thereby to jointly form a larger interior room made of the first and second interiors.

In at least one embodiment, the mobile unit has two end walls and two longitudinal open side walls where the mobile unit is adapted to be interconnected between two similar or different mobile units to form a compound structure with a large interior room.

Other features and advantages of the present application will become apparent from the following detailed description taken together with the accompanying drawings. It should be understood, however, that the detailed description and the specific examples, while indicating preferred embodiments of the application, are given by way of illustration only, since various changes and modifications within the spirit and scope of the application will become apparent to those skilled in the art from this detailed description. For example, aspects described and depicted herein may be more generally applicable to fixed (i.e., immobile) constructions.

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment, and which are now described. The drawings are not intended to limit the scope of the teachings described herein.

Figure 1:
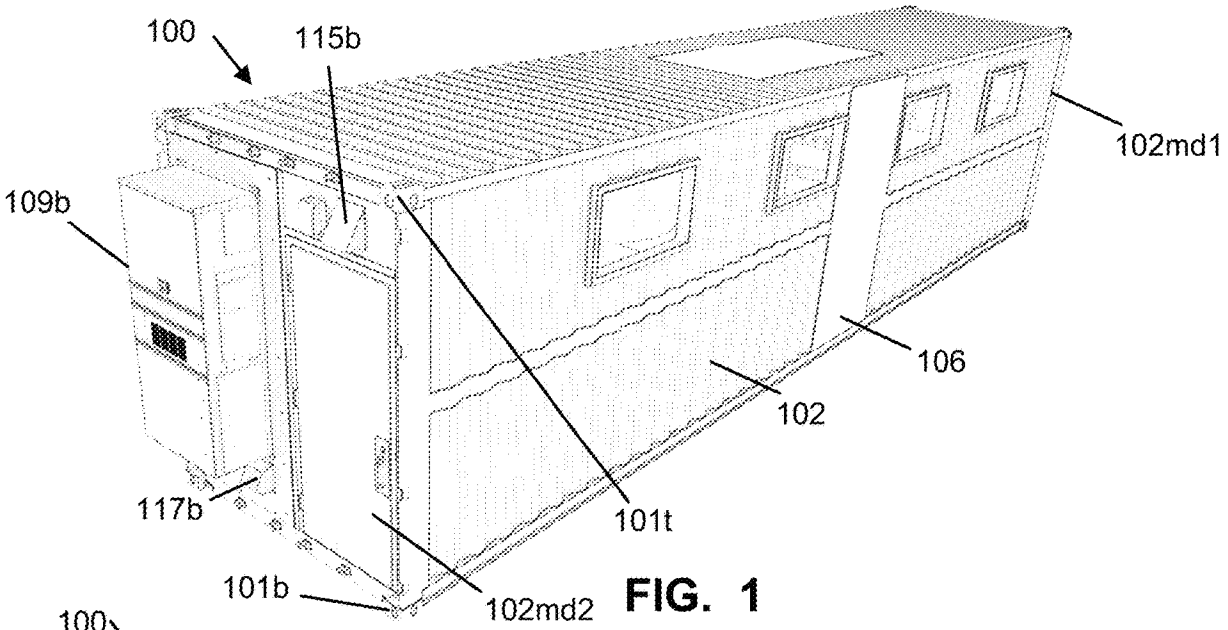
FIG. 1 is a front perspective view of a mobile/portable medical unit, according to an example embodiment in accordance with the teachings herein.

Further aspects and features of the example embodiments described herein will appear from the following description taken together with the accompanying drawings.

DETAILED DESCRIPTION OF THE EMBODIMENTS

The headings and Abstract of the Disclosure provided herein are for convenience only and do not interpret the scope or meaning of the embodiments.

Various embodiments in accordance with the teachings herein will be described below to provide an example of at least one embodiment of the claimed subject matter. No embodiment described herein limits any claimed subject matter. The claimed subject matter is not limited to devices, systems, or methods having all of the features of any one of the devices, systems, or methods described below or to features common to multiple or all of the devices, systems, or methods described herein. It is possible that there may be a device, system, or method described herein that is not an embodiment of any claimed subject matter. Any subject matter that is described herein that is not claimed in this document may be the subject matter of another protective instrument, for example, a continuing patent application, and the applicants, inventors, or owners do not intend to abandon, disclaim, or dedicate to the public any such subject matter by its disclosure in this document.

It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures, and components have not been described in detail so as not to obscure the embodiments described herein. Also, the description is not to be considered as limiting the scope of the embodiments described herein.

It should also be noted that the terms "coupled" or "coupling" as used herein can have several different meanings depending in the context in which these terms are used. For example, the terms coupled or coupling can have an electrical, mechanical or structural connotation. For example, as used herein, the terms coupled or coupling can indicate that two elements or devices can be directly connected to one another or connected to one another through one or more intermediate elements or devices via an electrical signal, an electrical connection, a mechanical element, a structural element or an airflow depending on the particular context.

Unless the context requires otherwise, throughout the specification and claims which follow, the word "comprise" and variations thereof, such as, "comprises" and "comprising" are to be construed in an open, inclusive sense, that is, as "including, but not limited to".

It should also be noted that, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

It should be noted that terms of degree such as "substantially", "about" and "approximately" as used herein mean a reasonable amount of deviation of the modified term such that the end result is not significantly changed. These terms of degree may also be construed as including a deviation of the modified term, such as by 1%, 2%, 5%, or 10%, for example, if this deviation does not negate the meaning of the term it modifies.

Furthermore, the recitation of numerical ranges by endpoints herein includes all numbers and fractions subsumed within that range (e.g., 1 to 5 includes 1, 1.5, 2, 2.75, 3, 3.90, 4, and 5). It is also to be understood that all numbers and fractions thereof are presumed to be modified by the term "about" which means a variation of up to a certain amount of the number to which reference is being made if the end result is not significantly changed, such as 1%, 2%, 5%, or 10%, for example.

Reference throughout this specification to "one embodiment", "an embodiment", "at least one embodiment" or "some embodiments" means that one or more particular features, structures, or characteristics may be combined in any suitable manner in one or more embodiments, unless otherwise specified to be not combinable or to be alternative options.

As used in this specification and the appended claims, the singular forms "a," "an," and "the" include plural referents unless the content clearly dictates otherwise. It should also be noted that the term "or" is generally employed in its broadest sense, that is, as meaning "and/or" unless the content clearly dictates otherwise.

The example embodiments of some of the devices, systems, or methods described in accordance with the teachings herein are generally implemented as a combination of hardware and software. For example, the embodiments described herein may be implemented, at least in part, by using one or more computer programs, executing on one or more programmable devices comprising at least one processing element and at least one storage element (i.e., at least one volatile memory element and at least one non-volatile memory element). The hardware may comprise input devices including at least one of a touch screen, a keyboard, a mouse, buttons, keys, sliders, and the like, as well as one or more of a display, a printer, one or more sensors, and the like depending on the implementation of the hardware.

It should also be noted that some elements that are used to implement at least part of the embodiments described herein may be implemented via software that is written in a high-level procedural language such as object-oriented programming. The program code may be written in C++, C #, JavaScript, Python, or any other suitable programming language and may comprise modules or classes, as is known to those skilled in object-oriented programming. Alternatively, or in addition thereto, some of these elements implemented via software may be written in assembly language, machine language, or firmware as needed. In either case, the language may be a compiled or interpreted language.

At least some of these software programs may be stored on a computer readable medium such as, but not limited to, a ROM, a magnetic disk, an optical disc, a USB key, and the like that is readable by a device having a processor, an operating system, and the associated hardware and software that is necessary to implement the functionality of at least one of the embodiments described herein. The software program code, when read by the device, configures the device to operate in a new, specific, and predefined manner (e.g., as a specific-purpose computer) in order to perform at least one of the methods described herein.

At least some of the programs associated with the devices, systems, and methods of the embodiments described herein may be capable of being distributed in a computer program product comprising a computer readable medium that bears computer usable instructions, such as program code, for one or more processing units. The medium may be provided in various forms, including non-transitory forms such as, but not limited to, one or more diskettes, compact disks, tapes, chips, and magnetic and electronic storage. In alternative embodiments, the medium may be transitory in nature such as, but not limited to, wire-line transmissions, satellite transmissions, internet transmissions (e.g., downloads), media, digital and analog signals, and the like. The computer useable instructions may also be in various formats, including compiled and non-compiled code.

In accordance with the teachings herein, there are provided various configurations of portable, semi-permanent or permanent units as well as various techniques and materials usable for construction of these units. The following description and drawings set forth embodiments in which the portable units are portable medical units constructed based on intermodal/shipping containers. However, many aspects described and depicted herein are generally applicable to portable units being constructed using other materials and/or for other applications. Furthermore, aspects described and depicted herein may be more generally applicable to portable, semi-permanent or fixed (i.e., immobile or permanent) constructions.

For example, various embodiments of an air control system and associated control methods are described herein that generally apply to a structure having a room, with it not necessarily being a medical room. Furthermore, while the description provides examples in which the teachings herein are applied to a portable structure, which in this case is a mobile medical unit having a room that is a patient chamber, examples of other applications in which the teachings herein can be applied include other types of structures such as, but are not limited to, educational structures including classroom portables, military structures, correctional facilities, penitentiary structures, testing and vaccination centres, quarantine facilities, modular laboratory structures, cleanrooms, long-term care facilities, natural disaster safe shelters, indigenous community housing, vertical farming, grow rooms, clean rooms, mobile restaurants, mobile bars, cottages, retail structures, mining structures, modular housing, social housing and remote communities, for instance.

Furthermore, at least some of the teachings herein may be adapted for and generally applicable to fixed (i.e., immobile) constructions such as, but not limited to, fixed infrastructure for hospitals and medical clinics, educational structures including classroom portables, military structures, correctional facilities, penitentiary structures, testing and vaccination centres, quarantine facilities, laboratory structures, cleanrooms, long-term care facilities, natural disaster safe shelters, indigenous community housing, vertical farming, grow rooms, clean rooms, mobile restaurants, mobile bars, cottages, retail structures, mining structures, modular housing, social housing and remote communities, for instance.

It has been realized by the inventor that there may be various applications, for mobile, portable, semi-permanent or permanent structures, such as, for example, medical applications which may require that a particular room or chamber, such as a patient room, an ICU, an OR unit or a classroom unit, which may be directly connected to outside air or to another structure, be controllably maintained at either a positive air pressure (i.e., a higher pressure than ambient pressure), a negative air pressure (i.e., a lower air pressure than ambient pressure) or a neutral air pressure (i.e. at the same air pressure as ambient pressure). For example, negative pressure may be used where there is an airborne illness or where aerosol-generating procedures are being done to decrease viral load. Positive pressure may be used for some OR (e.g., surgical) procedures to ensure airborne pathogens do not contaminate the structure. With a structure that is at positive air pressure, contaminants (e.g., virus containing air, particles, and droplets) that may be present at the exterior of the structure are generally kept, due to the pressure differential between the interior and exterior of the chamber, from seeping into the interior of the structure, with the exception of air that is deliberately conveyed into the interior of the structure via ducts and filtration equipment. With a structure that is at negative air pressure, the contaminants that may be present in the interior of the chamber are generally kept, due to the pressure differential, from seeping to the exterior of the structure, again with the exception of air that is deliberately conveyed out of the interior of the structure via ducts and filtration equipment.

In another aspect, in accordance with the teachings herein, there is described at least one embodiment of a controllable airflow system for a structure, which may be mobile/portable, semi-permanent or permanent, that can be controlled to render a structure and with which the controllable airflow system is associated and may be controlled to transition air pressure in the structure to a positive pressure configuration, a negative pressure configuration, or a neutral pressure configuration as well as set the amount of positive or negative pressure.

Ambient pressure is generally defined as being the pressure that surrounds an object. For example, ambient pressure may be the pressure of the environment that surrounds the room whose pressure is being controlled to be a positive pressure, negative pressure or neutral pressure with respect to its surrounding environment. In some cases, the ambient pressure may be the outside open-air environment. In at least some cases, the ambient pressure may be at about 1 atmosphere or about 101.3 kPa. The surrounding environment depends on the nature of the room, chamber or structure. For example, the room, chamber or structure may be directly vented to receive air flow from and provide air flow to the outside environment (e.g., atmosphere). Alternatively, the room or chamber may be part of a mobile/portable, semi-permanent or permanent structure where the chamber is vented to receive air flow from and provide air flow to another structure, such as another room, a hallway or the HVAC system of a larger structural environment.

It should be understood that the word chamber and room, as used herein, may be used synonymously in that they both represent a unit or sub-structure with air pressure that is controllable by an air flow control system.

It should also be understood herein that the words portable and mobile may be used synonymously and interchangeable in that they both represent a structure or unit that may be moved from one location to another location or may be a temporary structure that can be assembled at a first location, and then be disassembled and the parts moved to a second location where it is reassembled.

In another aspect, in accordance with the teachings herein, portable, semi-permanent or permanent structures may be provided with an example embodiment of a flexible airflow control system that enables a given unit, or an individual chamber in a multi-chamber mobile unit, to operate selectively and independently, from other rooms or chambers, such that it can be independently transitionable to any one of a negative pressure chamber, a positive pressure chamber, and a neutral pressure chamber. The present application also describes example embodiments of systems and methods for conditioning the air and also controlling the pressure in the chamber for some use or patient requiring pressure conditions that are different than that which existed during a previous use of the same chamber.

Furthermore, in another aspect of the teachings herein, in at least one embodiment, semi-permanent or permanent structures may have a first individual chamber/room of a multi-chamber unit/room structure operating as a negative pressure chamber while another individual chamber of the multi-chamber unit/structure is operating independently as either a positive pressure chamber or a neutral pressure chamber. In such embodiments, a common air flow control system or separate air flow control systems may be used for the separate chambers whose pressure is to be controlled independently from other chambers.

Furthermore, in another aspect, in accordance with the teachings herein, there is provided at least one embodiment of an air flow control system for use with portable, semi-permanent or permanent structures that controls the air pressure of an individual chamber of a multi-chamber mobile unit/structure is controllable, either automatically or under user control, to provide various positive pressures thereby to maintain a positive pressure within such chambers while also enabling control over whether the positive pressure is increased or decreased or to control the air pressure in such chambers to provide various negative pressures to maintain a negative pressure within a chamber while also enabling control over whether the negative pressure is increased or decreased.

Furthermore, in another aspect, in accordance with the teachings herein, there is provided at least one embodiment in which substantially fluid-tight connections between two or more physically combined mobile units are used, with the connections being automatically resilient to pressure conditions in a mobile unit, or an individual chamber of a multi-chamber unit, being changed between negative, positive, and neutral pressures.

In another aspect, the teachings herein can be applied to the assembly of various individual units, which may be mobile units (which may be medical), anteroom modules, hallway modules, connection modules, pharmacy modules, nurse station modules, and/or classroom modules, for example, so that these units can be combined into various configurations of compound structures useful for forming particular custom and scalable configurations such as, but not limited to, multiple-bed hospital and ICU and OR medical units.

Figure 2:
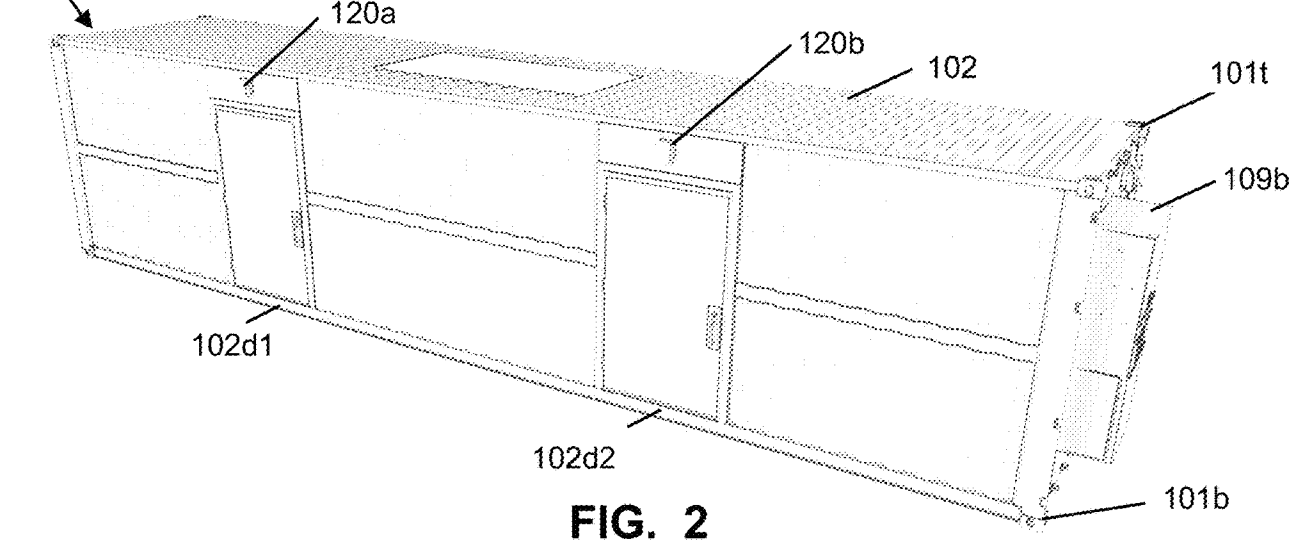
FIG. 2 is a rear perspective view of the mobile/portable medical unit of FIG. 1.
Figure 3:
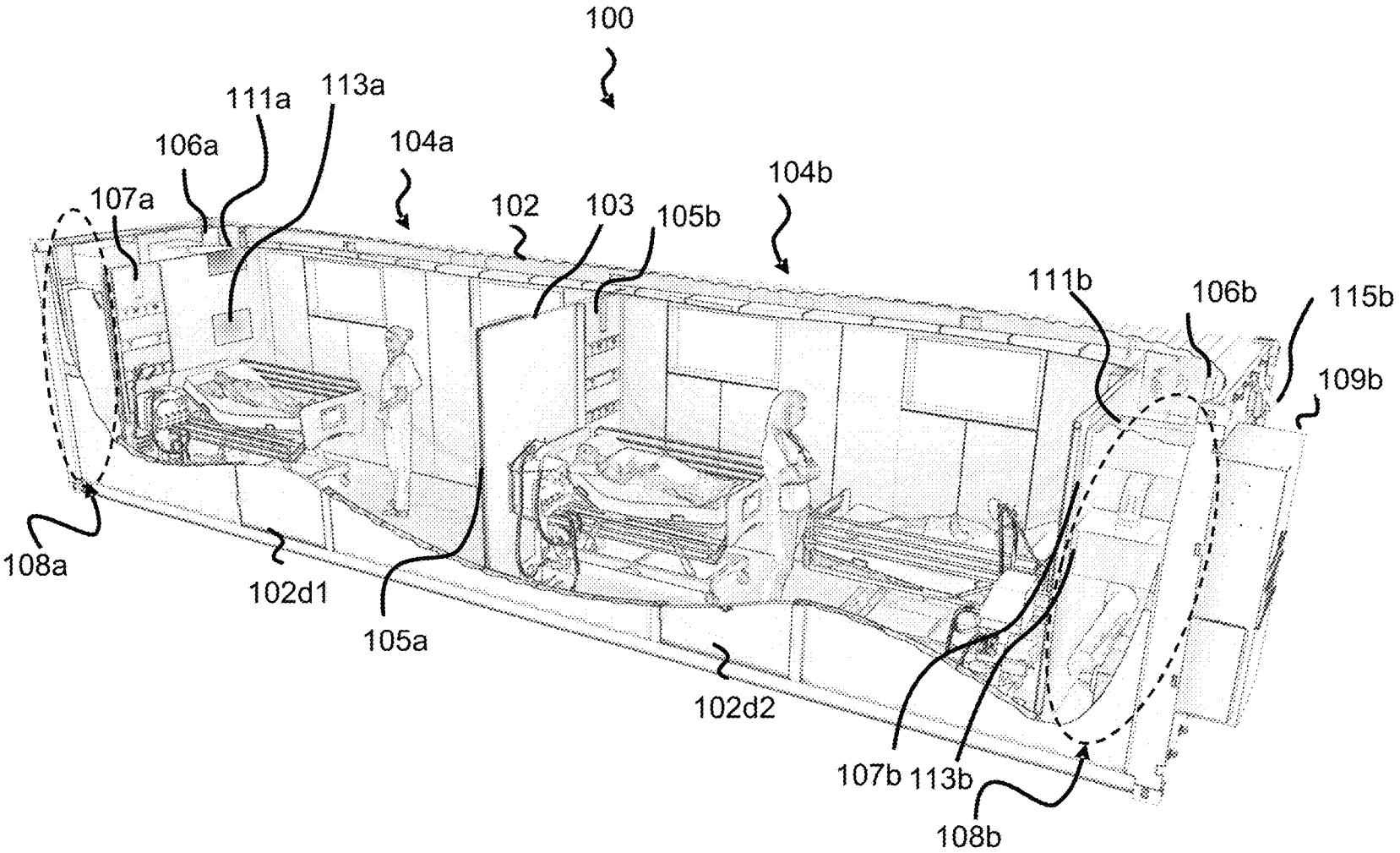
FIG. 3 is a rear perspective view of the mobile/portable medical unit of FIG. 1, showing one example embodiment, with parts of the roof/ceiling and rear wall shown cut away to reveal the interior divided into two halves, each for containing an ICU or OR chamber and a maintenance room that are independent of one another.

Referring now to FIGS. 1 to 3, FIG. 1 is a front perspective view of a mobile medical unit 100, according to an example embodiment, FIG. 2 is a rear perspective view of the mobile medical unit 100 of FIG. 1 and FIG. 3 is a perspective view of the unit 100 in one example use with a portion of the wall and ceiling of the unit 100 cutout. In this example embodiment, the unit 100 is based on a high cube shipping/intermodal container 102 having a length of about 40 feet, a width of about 8 feet, and a height of about 9 feet (other dimensions may be used in other embodiments). The unit 100 has doors 102*d*1, 102*d*2 to access chambers enclosed therein. The doors 102*d*1, 102*d*2 may be implemented such that they are self-closing and provide a pressure seal. The unit 100 also has maintenance doors 102*md*1 and 102*md*2 (only one of which is shown) at opposite ends of the container 102 for accessing maintenance rooms. The unit 100 also includes top connectors 101*t* and bottom connectors 101*b* which may be on each upper and lower corner. Only two of the connectors 101*t* and 101*b* have been labelled for each of illustration. The connectors 101*t* and 101*b* may also be referred to as corner castings in certain embodiments. As previously described, while the teachings herein are described with reference to the mobile medical unit 100, the teachings are also applicable to other types of portable, semi-permanent or permanent structures that may be used for a variety of purposes as described earlier.

The shipping container 102 has been fitted with a fluid-tight wall splitting the container 102 into two halves. Each half of the unit 100 has respective patient chambers 104*a*, 104*b*, and respective maintenance rooms 106*a*, 106*b*. In this example embodiment, each patient chamber 104*a*, 104*b* is provided with two windows for, in turn, providing the patients in each chamber with a sense of the environment outside of the respective patient chambers 104*a*, 104*b*. Alternatives in window configuration (more or fewer windows, or differently sized windows) are possible. In at least one embodiment, the windows may be openable only by the use of a tool/keys. In at least one alternative embodiment, the windows may be permanently sealed.

Maintenance rooms 106*a*, 106*b* house equipment comprising airflow systems 108*a*, 108*b*, respectively, which include, but are not limited to conduits and filtration. Each maintenance room 106*a*, 106*b* also houses electrical, gas and other operational and medical components for handling conditions and capabilities within the respective patient chamber 104*a*, 104*b*, as will be described. Each maintenance room 106*a*, 106*b* is also physically and fluidically coupled with HVAC equipment.

In this example embodiment, each maintenance room 106*a*, 106*b* is only accessible via a respective door 102*md*1, 102*md*2 from outside of the unit 100, and not via the respective patient chamber 104*a*, 104*b* itself. The HVAC equipment associated with each maintenance room 106*a*, 106*b* includes, in this example embodiment, components for heating, ventilation, air conditioning and humidity control. In other embodiments, other components may be included in the maintenance rooms.

The HVAC equipment is housed in a respective box 109*a*, 109*b* that is positioned beside the maintenance room door 102*md*2 at the exterior of the unit 100, so that it may be maintained or repaired without personnel necessarily having to enter into the maintenance rooms 106*a*, 106*b*. In this example embodiment, the HVAC equipment provides a high latent capacity humidity and sound reduction for removing high amounts of humidity, a 24,000 BTUH rated cooling capacity, and a 34,130 BTUH rated heating capacity. The HVAC equipment may include a BARD 11EER Single Stage Dehumidification W24HBD_W36HBD HVAC unit. Furthermore, to reduce costs in maintenance, a hydrophilic evaporator coil may be incorporated. Such a coil is useful for reducing or preventing mold growth, aiding with drainage, and for protecting components against corrosive particulates that may be in the incoming airstream. However, in other embodiments other types of HVAC equipment having other capacity or operational capabilities may be used.

Figure 4:
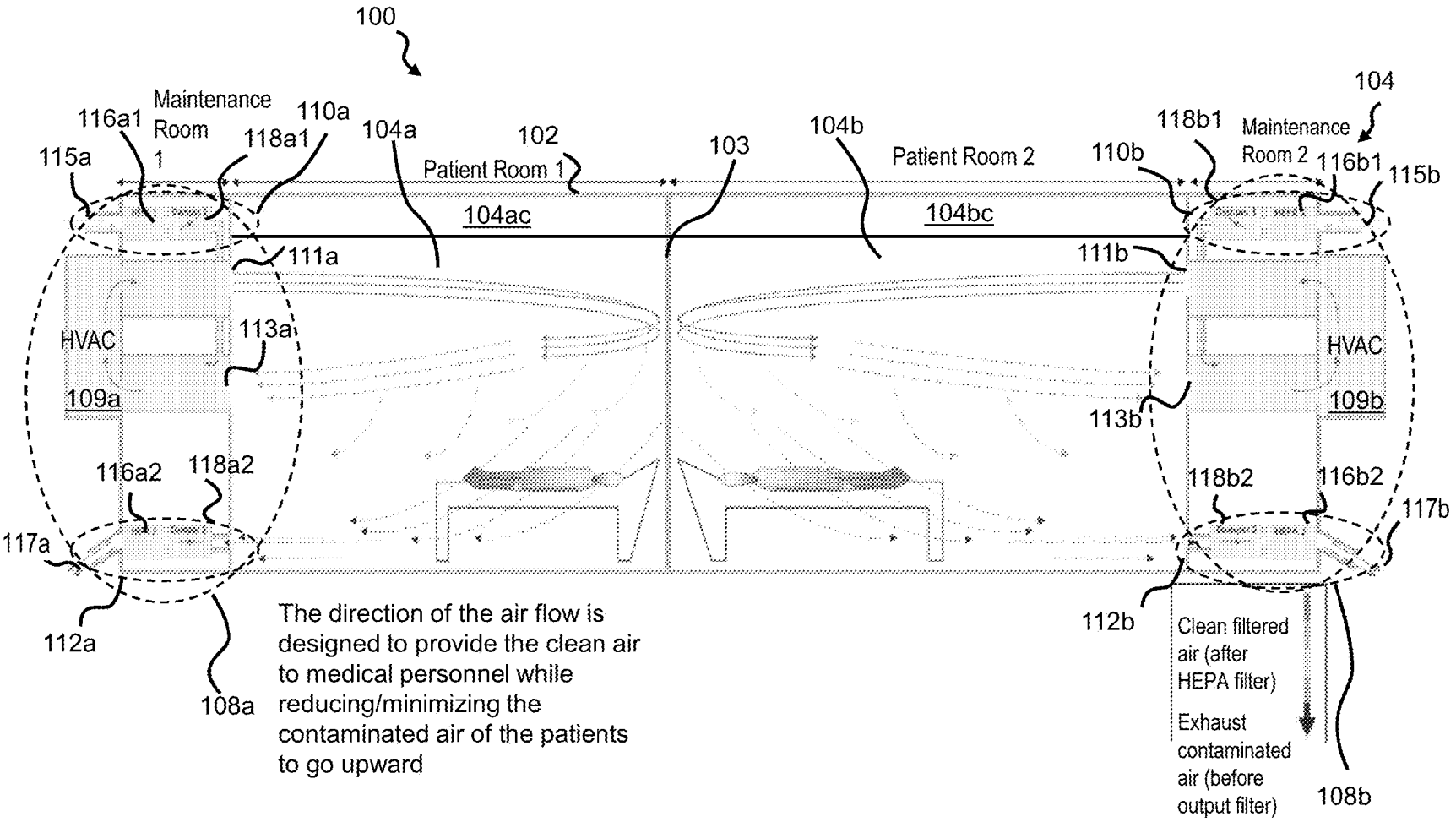
FIG. 4 is a sectional diagram of the mobile/portable medical unit of FIG. 1, showing the ingress, flow, and egress of air for each of the two independent ICU and OR chambers.

Referring now to FIG. 4, airflow systems 108*a*, 108*b* comprise air inlet subsystems 110*a*, 110*b*. Air inlet subsystems 110*a*, 110*b* are positioned above the maintenance room door (not shown) for enabling an airflow systems 108*a*, 108*b* to convey ambient air from the exterior of the unit 100 into the respective interior chambers 104*a*, 104*b*. The outlet of the air inlet subsystems may be located so that they supply air at a height that may be close to the ceiling (and above the bed in the room for this example).

Similarly, airflow systems 108*a*, 108*b* comprise air outlet subsystems 112*a*, 112*b* that are positioned below the respective HVAC equipment box 109*a*, 109*b* to convey air from the interior of the chambers 104*a*, 104*b* of the unit 100 out to its exterior. Air outlet subsystems 112*a*, 112*b* direct air being expelled downwards from a point that is a certain distance above the ground such as, but not limited to, about 10 inches, for example, to the exterior of the container 102. The handling of air intake, filtration, conditioning and expulsion, is described in further detail below.

In at least one embodiment, the outlets of the air outlet subsystems 112*a*, 112*b* may be positioned so that they are a certain distance from ventilation intakes or occupied areas such as at least about 10 ft, for example.

In general, it is preferable, if possible, to have the airflow of clean air move towards the patient and then move from the patient to the exhaust in as short a route as possible. Thus, in at least one embodiment, the air outlet subsystems 112*a*, 112*b* may be located near the floor close to the bed, with the inlet of the air outlet subsystems 112*a*, 112*b* being located possibly about 6 inches to 1 foot above the floor.

In at least one embodiment, the exhaust ducts (e.g., air outlets) of the air outlet subsystems 112*a*, 112*b* may be oversized to allow for loss of efficiency, e.g., expected airflow plus 50%.

In this example embodiment, each patient chamber 104*a*, 104*b* is only accessible via a respective door 102*d*1, 102*d*2 from outside of the unit 100. In this embodiment, these doors 102*d*1, 102*d*2 do not include windows. As such, the patients may be monitored using one or more closed circuit cameras that are positioned throughout each patient chamber 104*a*, 104*b* and in communication with video monitors that are located outside of the patient chambers 104*a*, 104*b*. However, in alternative embodiments windows may also be included in these doors 102*d*1, 102*d*2 to enable those just outside the doors 102*d*1, 102*d*2 to observe a patient within the patient chamber 104 without necessarily having to consult video monitors.

In alternative embodiments, it should be noted that the doors 102*d*1, 102*d*2 may instead lead to an ante-chamber or a hallway when the mobile medical unit 102 is part of a larger portable, semi-permanent or permanent structure, examples of which are later discussed.

In various embodiments, there may be a ½ inch gap under the doors 102*d*1, 102*d*2.

Figure 5:
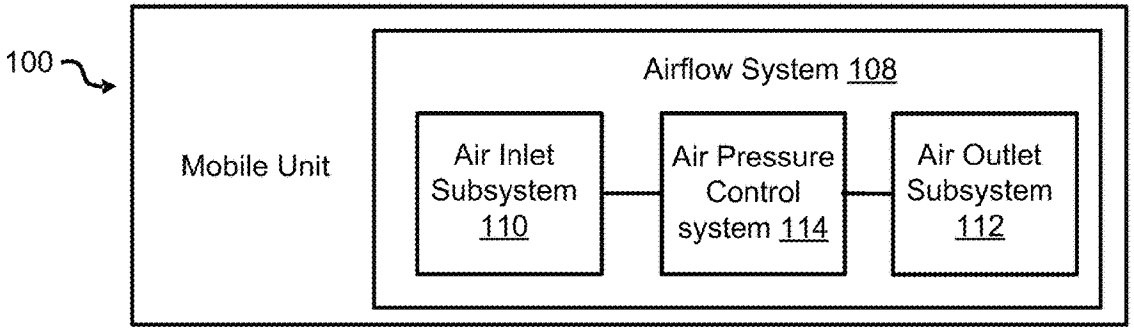
FIG. 5 is a block diagram showing an example embodiment of the airflow system of the mobile medical unit of FIGS. 1 to 4.
Figure 6:
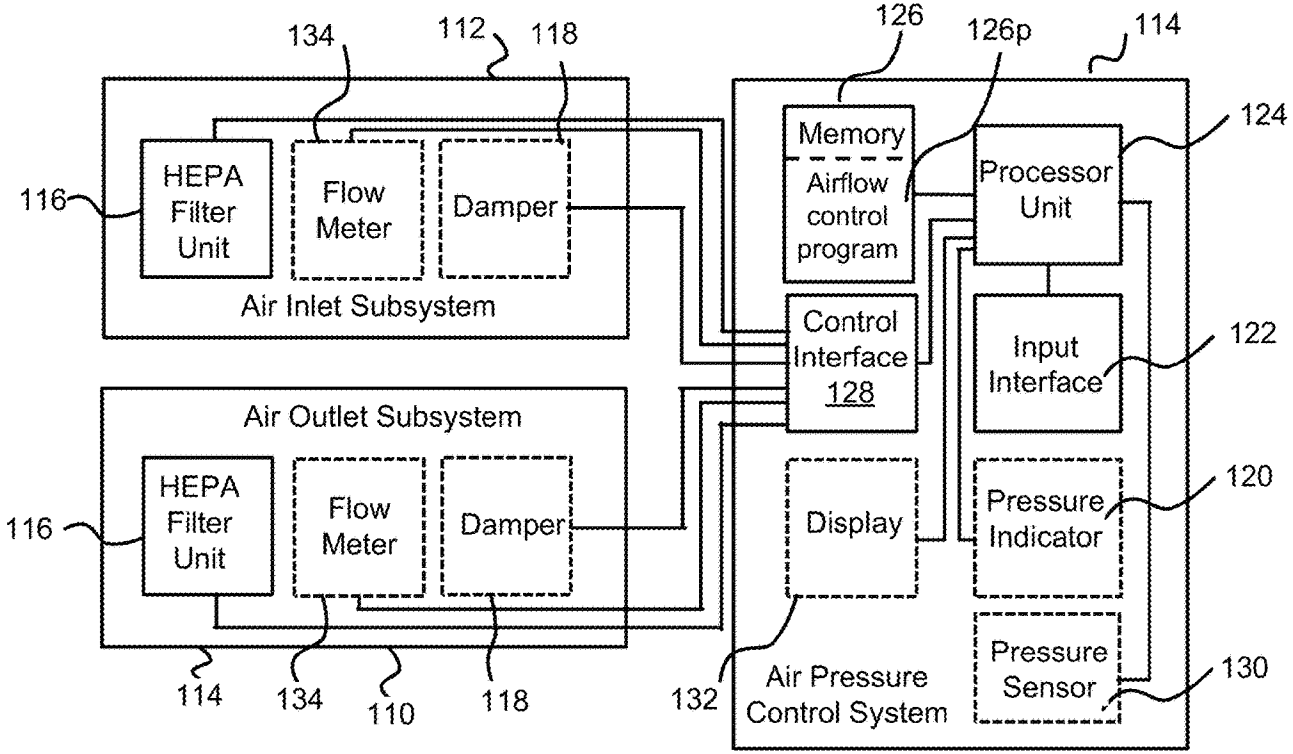
FIG. 6 is a block diagram showing an example embodiment of the air inlet subsystem, air outlet subsystem, and air pressure control system of the airflow system of FIG. 5.

As can be seen in FIGS. 5 and 6, airflow systems 108*a*, 108*b* further comprise air pressure control system 114 that can independently control the air pressure in each of the patient chambers 104*a*, 104*b* by sending separate control signals to the equipment that affects air flow in each of the patient chambers 104*a*, 104*b*. In alternative embodiments, there may be a separate air pressure control system 114 for each chamber whose pressure is to be controlled. For ease of description, in FIGS. 5 and 6, components are named using the same names as components to which they correspond to in FIG. 4 without using reference numerals that end in an "a" or a "b".

Referring to FIG. 6, air pressure control system 114 comprises processor unit 124, memory 126 with airflow control program 126*p*, input interface 122, and control interface 128. Air pressure control system 114 may also comprise display 132 (which is optional), a pressure indicator 120 (which is optional), and a pressure sensor 130 in at least one example embodiment. Input interface 122 may comprise a switch, knob, slider, lever, touchscreen or other control mechanism, or may also be a radio that is communicatively coupled to a smartphone, desktop or laptop that is running an application, such as a mobile application or a web application, that is used to communicate with the processor unit 124 for controlling the airflow system 108.

The processor unit 124 controls the operation of the air pressure control system 114 and may include one processor that can provide sufficient processing power depending on the configuration and operational requirements of the system 114. For example, the processor unit 124 may include a high-performance processor. The display 132 may be an LCD display.

The control interface 128 may be any hardware element that allows the processor unit 124 to communicate with elements within the air pressure control system 114, the air inlet subsystem 112 or the air outlet subsystem 114. For example, the interface unit 128 include at least one of a serial bus or a parallel bus, and a corresponding port such as a parallel port, a serial port, and/or a USB port. The control interface 128 may also include one or more Analog to Digital converters (ADCs) or a multichannel ADC when digital signals from the processor unit 124 are provided to analog components within the air inlet subsystem 112 or the air outlet subsystem 114. The control interface 128 may also include one or more Digital to Analog converters (DACs) or a multichannel DAC when analog signals from the air inlet subsystem 112 or the air outlet subsystem 114 are sent to the processor unit 124.

In at least one embodiment, one or more elements of the control interface 128 may be located so that they are not within reach of the patient, visitors, or any other members of the public, as the case may be, so that un-authorized people are not allowed to vary the operation of the air pressure control system 114. For example, one or more elements of the control interface may be key operated, and the keys may usually be locked, in a secure environment, such as a cupboard or a desk drawer, or the control means for controlling the operation of the air pressure control system 114 may be only accessible remotely by authorized personnel.

In embodiments where the input interface 120 allows the processor unit 124 to communicate with remote computing devices, a network port may be used so that the processor unit 144 can communicate via the Internet, a Local Area Network (LAN), a Wide Area Network (WAN), a Metropolitan Area Network (MAN), a Wireless Local Area Network (WLAN), a Virtual Private Network (VPN), or a peer-to-peer network, either directly or through a modem, router, switch, hub or other routing or translation device.

In some cases, the input interface may alternatively or additionally include various communication hardware for allowing the processor unit 124 to communicate with remote devices. For example, the communication hardware may include, a Bluetooth radio or other short range communication device, or a wireless transceiver for wireless communication, for example, according to CDMA, GSM, or GPRS protocol using standards such as IEEE 802.11a, 802.11b, 802.11g, or 802.11n.

The memory 126 stores program instructions for an operating system and an airflow control program 126*p*. When the program instructions for the airflow control program 126*p* are executed by a processor of the processor unit 124, the processor is configured for performing certain functions in accordance with the teachings herein. For example, the airflow control program 126*p* may include software instructions for generating a graphical user interface (GUI) on the display 132 and receiving input from a user who interacts with the GUI to set an air pressure configuration for room 104*a*, 104*b*. Alternatively, the airflow control program 126*p* may include software instructions for allowing the processor unit 124 to communicate with remote devices that a user may use to set an air pressure configuration for rooms 104*a*, 104*b*. The airflow control program 126*p* also includes software instructions for causing the processor unit 124 to send control signals to the dampers 118 to control the valve position thereof, as described in further detail below. This may be referred to as electronic damper control. Alternatively, in embodiments in which the HEPA filter unit 116 has a variable drive system, the dampers 118 are not included and the airflow control program 126*p* includes software instructions for causing the processor unit 124 to send control signals to the HEPA filter 116 to control the speed of the variable drive system, as described in further detail below. Therefore, in either of these embodiments, the air pressure control system 114 may be considered to function as a master controller that is configured to change the air pressure using multiple HEPA systems to cause differential pressure between the inlet air and exhaust air of the inlet air and outlet air subsystems respectively. This can do in some embodiments mechanically by using dampers within the ducting or in other embodiments electrically by changing the speed (e.g., RPM of the motor) of each HEPA system that have a variable drive system. In addition, the air pressure control system 114 may also be used to concurrently condition the air by, for example, controlling the HVAC to cool or warm the air that is provided to the room 104*a*, 104*b*.

As can be seen in FIG. 2, a pressure indicator 120—in this embodiment a colour-switchable lamp 120*a*, 120*b*, such as a light bulb or LED, is affixed above each of the patient chamber doors 102*d*1, 102*d*2. The pressure indicator 120 is incorporated into the air control system 114 to provide an indication, such as a particular light color, to observers who are outside of a patient chamber 104*a*, 104*b* what the current pressure configuration is (i.e., whether the patient chamber 104*a*, 104*b* is currently maintaining a positive air pressure, a negative air pressure, or a neutral air pressure). Alternatives are possible wherein the lamp 120*a*, 120*b* is associated with an independent system for monitoring the ongoing conditions of the patient chamber 104*a*, 104*b* which can then be used as input to the air pressure control system 114 so that it can determine whether to modify any control signals to the HEPA systems for maintaining a desired air pressure configuration or transitioning to a new air pressure configuration in any of the corresponding rooms. In at least one embodiment, a tri-color LED may be used rather than separate lamps.

In at least one embodiment, the pressure indicator 120 may be configured to provide a notification, which may be instant, if the pressurization within the chambers 104*a*, 104*b* fails or fluctuates too much. This may be done by measuring the pressure within the chambers 104*a*, 104*b* using pressure sensors, comparing the measured pressures to a predefined pressure threshold or a rate of change of room pressure to a predefined pressure rate change threshold and sending control signals to the pressure indicator 120 to indicate when the measured pressure is above or below the predefined threshold (depending on the air pressure configuration for the chambers 104*a*, 104*b*) or when the rate of change of the measured pressure is above the predefined pressure rate change threshold. The pressure sensors may be implemented so that they can measure changes in pressure of about 0.01 WC.

In at least one embodiment, there may be a visual alarm when the pressure indicator 120 is controlled to display that there is a problem with pressure in the chambers 104*a*, 104*b*, and/or there may be an audible alarm that is generated as well. The audible alarm and the pressure indicator 120 may be controlled to stop and not indicate a pressure problem when the pressure within the chambers 104*a*, 104*b* is restored to its desired operational value.

FIG. 3 is a rear perspective view of the mobile medical unit 100 of FIG. 1, with parts of the roof/ceiling and rear wall shown cut away to reveal its interior divided into two halves 104*a*, 104*b* by a middle wall 103, each for containing a respective patient chamber 104*a*, 104*b* and a maintenance room 106*a*, 106*b*. The middle wall 103 fluidly seals patient chamber 104*a* from patient chamber 104*b*, such that no air may flow between patient chambers 104*a*, 104*b*. This therefore allows for the chambers 104*a*, 104*b* to each have a different or similar pressure configuration relative to one another. For example, the middle wall 103 may be sealed with foam or sealant materials and/or may be optionally permanently welded in place. In this example embodiment, each patient chamber 104*a*, 104*b* is sized to accommodate up to two beds, and thus two patients, with the head of one bed facing the middle wall 103 and the head of the other bed facing an end wall that divides the patient chamber 104*a*, 104*b* and the maintenance room 106*a*, 106*b*.

In general, the chambers 104*a*, 104*b* are "well-sealed", which this includes applying sealing to the ceiling panels and the regions where the ceiling panels meet the wall panels. For example, acoustic ceiling tiles may be replaced with non-porous vinyl ceiling tiles and gaskets can be applied at the tile connections in the ceiling grid. A sealant, such as a medical grade sealant that is able to withstand changes in room pressure, may be applied in between each ceiling panel. In at least one embodiment, each ceiling tile may be fastened to one another (e.g., riveted to one another) for extra strength to withstand changes in room pressure during use. Gaskets may be also provided around items which are used to enter into the room as well as for other objects that are installed in the walls such as, e.g., electric sockets, gas supplies, phone lines, etc. In addition, recessed light fixtures may be replaced with surface-mounted fixtures.

In at least one embodiment, there may also be ceiling cavities 104*ac*, 104*bc* (see FIG. 4A) that are in each patient room 104*a*, 104*b* that are sealed so that they can be pressurized at a desired pressure. For example, the ceiling cavities 104*ac*, 104*bc* may be pressurized so that they are at the same ambient pressure as the outside environment to the rooms 104*a*, 104*b*. The ceiling cavities 104*ac*, 104*bc*, may also be pressurized to provide a barrier for sound attenuation for noises from the outside environment. The ceiling cavities 104*ac*, 104*bc* may also be used to house certain equipment such as, but not limited to, piping for medical gases, one or more electrical conduits and possible further air ducting if required.

For example, in at least one embodiment, the cavities 104*ac*, 104*bc* may include further ducting from outlets of the HVAC systems 109*a*, 109*b* (that is at a different location compared to what is shown in FIG. 4A) so that the airflow into the patient rooms 104*a*, 104*b* may be provided from ceiling outlets that are located in the ceilings and directed downwards so that the air flow into the rooms 104*a*, 104*b* starts along a downward vertical trajectory. Alternatively, the ceiling outlets may be below the lower surface of the ceiling and have a horizontal orientation so that the airflow starts off having a horizontal orientation.

In this example embodiment, headwall units 105*a*, 105*b* extend from both sides of the middle wall 103. The middle wall 103 may be structurally designed, such that it is foam sealed and fastened to each side wall of the container 102 using angle formed strips around the entire perimeter, on both side walls and at the ceiling and floor of the container 102, thereby to provide strength for a headwall unit 105*a*, 105*b* at this position for each of the patient chambers 104*a*, 104*b* as shown in FIG. 3. Furthermore, headwall units 107*a*, 107*b* extend from opposite headwalls of both patient chambers 104*a*, 104*b*, thereby to provide another headwall unit at this position for each of the patient chambers 104*a*, 104*b*. In this example embodiment, each headwall unit 105*a*, 105*b*, 107*a*, 107*b* is a rectangular box fixedly attached to its respective wall. Each headwall unit 105*a*, 105*b*, 107*a*, 107*b* may have a depth of about four (4) inches, runs from the ceiling to the floor, and having connection points, rails and/or other accommodations for connecting monitors and other components. However, other configurations are possible in alternative embodiments.

In this example embodiment, the headwall units 105*a*, 105*b*, 107*a*, 107*b* and other outlets within the mobile medical unit 100 may be furnished with medical grade electrical components, including gas piping certified to Canadian, American and/or international medical standards, three (3) oxygen ports, one (1) medical gas port, and three (3) suction ports. Also provided are six (6) 120 V, 15 Amp duplex hospital-grade receptacles, and two (2) 120 V, 20 Amp duplex hospital-grade receptacles, each with GFCI circuitry, as well optionally one or more phone line outlets and optionally a television connection. The number and type of ports can vary depending on the type of room or based on different construction standards that exist for different jurisdictions (e.g., states or countries). The headwall units 105*a*, 105*b* can also be implemented to provide areas for affixing medical devices such as monitors, for example. For the headwall unit 105*a*, 105*b*, medical grade gas may be routed using pipes above the ceiling of the chambers 104*a*, 104*b* in ceiling cavities 104*ac* and 104*bc*, where these pipes are connected to gas sources.

In order to provide electrical utilities to the unit 100, the unit 100 is capable of a 208 Volt, 50-Ampere connection via a manual transfer switch with, in this example embodiment, connections for connecting to a backup generator. In alternative embodiments, the power connections may have another power capacity depending on the type of room and/or the type of construction standards that exist for different jurisdictions (e.g., in particular, provinces, states or countries). In at least one embodiment, the unit 100 may further comprise at least one solar cell, one or more wind turbines, an electric generator, electric vehicles or other renewable or non-renewable electricity sources to provide electrical utilities to the mobile medical unit 100. In at least one embodiment, the unit 100 may further incorporate an electrical distribution system that incorporates or can connect with an uninterrupted power supply (UPS) for ensuring that power continues to be routed to key receptacles in the event of a municipal or facilities power failure. In at least one embodiment, each unit may be outfitted with an automated transfer switch that may automatically actuate in the event of municipal power failure. Alternatively, power to the unit 100 may be provided by alternate power sources such as renewable or non-renewable energy sources including, but not limited to, solar, wind, electric, natural gas, diesel, turbine and electric vehicles through a bi-directional charging station.

The floor of each patient chamber 104*a*, 104*b*, in this example embodiment, may be clad with medical-grade polyurethane flooring such as the medical-grade Polyclad Pro PU available from Polyflor Limited in the United Kingdom. Alternative formats or suppliers of flooring that comply with required quality and safety standards may be employed. In this at least one example embodiment, the flooring may feature a raised perimeter running six (6) inches up the walls, providing a floor-to-wall barrier to dirt, fluids and other contaminants. The flooring may be, in at least one embodiment, suitable for use in ISO1466-11999 Class 4 clean rooms, and may be classified as a Class A product, including non-shedding to ASTM F51, complying with CAN/ULC-S102.2. Alternative formats for the flooring and/or suppliers of flooring that comply with quality and safety standards that apply to the structure that the chambers 104*a*, 104*b* are used with may be employed in alternative embodiments. In at least one embodiment, the mobile unit 100 may have a floor made of structural steel. For applications having less stringent requirements, alternative flooring may be used.

It should be noted that the structural elements used for the walls, floors, roofing structures and ceiling panels described herein can be made using any suitable material. In at least one example embodiment, the materials that may be used include carbon-based thermoplastics.

Referring now to FIG. 4, opposite from the headwall units 107*a*, 107*b* along each end wall are both inlet air vents 111*a*, 111*b* and return air vents 113*a*, 113*b* for the HVAC units 109*a*, 109*b*, respectively. In this example embodiment, the inlet vents 111*a*, 111*b* for the rooms 104*a*, 104*b* are the upper vents that are situated at the upper portion of the unit 100 for conveying air towards the interior of the room 104*a*, 104*b*, and the return vents 113*a*, 113*b* for the rooms 104*a*, 104*b* are the lower vents receiving air from the interior of the room 104*a*, 104*b* where this air is to be re-conditioned. An outlet vent (not shown) conveys air from the interior of the room 104*a*, 140*b*, via filtration as will be described, towards the outlet vent positioned beneath the HVAC box 109*a*, 109*b* on the exterior of the mobile medical unit 100 to the outside environment.

FIG. 4 is a sectional diagram of the mobile medical unit 100, showing the ingress, flow, and egress of air for each of the two independent patient chambers 104*a*, 104*b*. With respect to the patient chamber 104*a*, 104*b* in FIG. 4, ambient air is drawn rightward from the exterior via an inlet 115*a*, 115*b* of the air inlet subsystem 110*a*, 110*b* by a combined filter-motor unit 116*a*1, 116*b*1 at a predefined inlet rate. In this example embodiment, the combined filter-motor unit 116*a*1, 116*b*1 for this fresh air intake is a HEPA (High Efficiency Particulate Air) filter unit 116*a*1, 116*b*1, which may be rated at about 245 Cubic Feet per Minute (CFM). It will be appreciated that the HEPA filter unit 116*a*1, 116*b*1 is at least 99.97% efficient at removing particles that are 0.3 microns in size or larger. Furthermore, as the HEPA filter unit 116*a*1 becomes dirtier, it become more capable of capturing particles as small as 0.001 microns. The physical size of the HEPA filter unit 116*a*1, 116*b*1 is selected to fit within the space provided and also be approximately directly proportional to the volume of airflow that is used for the chambers 104*a*, 104*b*.

Because the HEPA filter unit 116*a*1, 116*b*1 delivers a steady volume of air through the ducting system, reductions in air flow exiting the HEPA filter unit 116*a*1, 116*b*1 below a predefined threshold can signify the HEPA filter unit 116*a*1, 116*b*1 needs service, such as a filter change or more involved service such as electrical or mechanical work. Since airflow and filtration of airflow affect the quality of air and the pressure within the chambers 104*a*, 104*b*, in this example embodiment, an air-flow meter 134 (see FIG. 5) is installed in each duct just downstream of the respective HEPA filter unit 116*a*1, 116*b*1 to measure and detect the inlet rate and any pressure decreases below a predefined threshold. In this example embodiment, since the HEPA filter units 116*a*1, 116*b*1 each deliver an inflow rate of about 245 CFM, and the air-flow meter 134 is used to trigger an alarm signal when the air-flow meter 134 detects the pressure has dropped a certain threshold amount below about 240 CFM to 245 CFM. The alarm signal may be an audible alarm, a visual alarm, both, or the alarm may be raised in the form of a message to a wireless device or the display of a signal on a control panel. In at least one embodiment, the alarm signal may be an electronic signal that is conveyed to the processor unit 124 which then sends a control signal to the appropriate mechanical elements so that the pressure is changed to be closer to the desired pressure setting.

In addition, in at least one embodiment, the air-flow meter 134 may be placed in the ducts associated with the HVAC equipment 109*a*, 109*b* to raise an alarm whenever airflow in the HVAC equipment 109*a*, 109*b* drops below a threshold level. Such airflow meters 134 also serve to provide an alert to personnel if power to the mobile medical unit 100 is cut off, since a power cut will also result in the cut off of threshold amounts of airflow to and from the mobile medical unit 100.

This filter-motor units 116*a*1, 116*b*1 are controlled by the air control system 114 to run at a steady rate. However, fresh air drawn in by the filter-motor units 116*a*1, 116*b*1 reaches a first damper unit 118*a*1, 118*b*1 (damper 1) which itself is controlled to provide greater or lesser damping thereby to enable incoming air to continue downstream from the damper unit 118*a*1, 118*b*1 with some amount of air volume damping or without. Air exits the damper unit 118*a*1, 118*b*1 at a location adjacent to the return vent 113*a*, 113*b*, but inside the maintenance room of the patient chambers 104*a*, 104*b* so that it is conveyed towards the HVAC equipment 109*a*, 109*b* for conditioning by heating, cooling and/or humidity treatment.

Once conditioned by the HVAC equipment 109*a*, 109*b*, the air is conveyed out of the inlet vent 111*a*, 111*b* and along the top of the patient chamber 104*a*, 104*b*. This air then mixes with air that is already in the patient chamber 104*a*, 104*b*. Upon reaching the middle wall 103, the air doubles back towards the middle of the patient chamber 104*a*, 104*b*. By conveying the air initially along the top of the patient chamber 104*a*, 104*b*, it is not directed at any medical personnel or patients. As depicted in FIG. 4A, some of this air enters the return vent 113*a*, 113*b* to be re-conveyed back towards the HVAC equipment 109*a*, 109*b* for re-conditioning.

This design is advantageous as the portion of air that doubles back and re-enters the HVAC 109*a*, 109*b* can be mixed together with the air from the filtered air from the HEPA filter units 116*a*1, 116*b*1 which was initially from the inlets 115*a*, 115*b* which acts to condition the filtered air and the mixture can then be conditioned by the HVAC units 109*a*, 109*b* before it exits via the vents 111*a*, 111*b* towards the rooms 104*a*, 104*b*. Due to this mixing of air that is already "conditioned" or treated (e.g. either heated or cooled) with the newly filtered air, the HVAC units 109*a*, 109*b* do not have to work as hard to condition this newly filtered inlet air. Accordingly, this allows for smaller size HVAC units 109*a*, 109*b* to be used which is important given the portable nature and smaller size of the containers 102 which provide a housing for the rooms 104*a*, 1 104*b* where the smaller size limits the components that are used.

However, some of the air doubling back falls towards the bottom of the patient chamber 104*a*, 104*b* and is drawn out of the patient chamber 104*a*, 104*b* by air outlet subsystem 112*a*, 112*b* at a predefined outlet rate. The air outlet subsystem 112*a*, 112*b* comprises a second filter-motor unit 116*a*2, 116*b*2, and a second damper unit 118*a*2, 118*b*2 (damper 2). In this example embodiment, the second filter-motor unit 116*a*2, 116*b*2 may also be a HEPA unit rated at about 245 CFM, to filter air before it is expelled outside of the mobile medical unit 100. The HEPA filter unit 116*a*2, 116*b*2 is being controlled by the air control system 114 to run at a steady rate. However, the second damper unit 118*a*2, 118*b*2 is controlled to provide greater or lesser damping thereby to enable exiting air to continue downstream from the damper unit 118*a*2, 118*b*2 with some amount of damping or without, so as to control the outlet rate and therefore the pressure within the rooms 104*a*, 104*b*.

However, in at least one embodiment, the return air vent to the HVAC system can be closed so that no air will re-circulate back through the HVAC system. In such embodiments, the HEPA system that receives fresh air may be sized to feed sufficient airflow into the return duct, thus allowing for a 100% air exchange.

As shown in FIG. 4, the physical components of the airflow systems 108*a* and 108*b* are distributed in that there is not one physical unit that houses all of the various physical components used by the systems 108*a* and 108*b*. For instance, using air inlet system 110*b* as an example, the HEPA filter unit 116*b*1, and the damper 118*b*1 may be located near an upper portion of the second maintenance room, the ducting for the HVAC unit 109*b* may be located below the HEPA filer unit 116*b*1 and the damper 118*b*1 and the actual HVAC unit 109*b* can be housed on the exterior of the second maintenance room but coupled to the ducting through holes in the exterior wall of the second maintenance room. In a similar fashion, the damper 118*b*2 and the HEPA filter unit 116*b*2 of the air outlet system 112*b* are located at the lower portion of the second maintenance room. Accordingly, this example layout distribution of the distributed air system components allows for the second maintenance room to take up a smaller physical footprint which in turn allows the interior of the patient room 104*b* to be larger in size thereby allowing for more medial components to be placed in the room 104*b*, which might be used as an ICU or an OR in other applications and so more medical equipment is needed, and there is also more space for medical personnel to move around within the room 104*b*.

In an alternative embodiment, the HEPA units, HVAC system or other airflow components can be placed in other locations, such as other parts of the shipping container housing, provided that the airflows shown in FIG. 4 are maintained. For example, the HEPA units may be placed outside the maintenance rooms as long as the same flow rate, operating conditions and connection points from the HEPA units to the HVAC systems or the interior of the room are maintained. For example, in embodiments where physical space is not a constraint, airflow system components can be located in a more spaced-out manner.

Referring to FIG. 5, the air control system 114 serves to control the damper units 118*a*1, 118*a*2, 118*b*1, 118*b*2 to provide more or less damping. In at least one example embodiment, the air control system 114 is a manual air control system with manual levers for controlling the valve positioning within each damper unit 118*a*1, 118*a*2, 118*b*1, 118*b*2 thereby to increase or decrease the amount of airflow damping. Position guide indicators may be affixed to the exterior of each damper unit 118*a*1, 118*a*2, 118*b*1, 118*b*2 to enable a person to successfully position the levers as desired, and thereby the pitch of the damper blades.

Preferably, in at least one embodiment, the damper units 118*a*1, 118*a*2, 118*b*1, 118*b*2 incorporate electrically controllable damper blades that can be electrically adjusted to increase or decrease the damping. In this way, the air control system 114 can centrally control the electrically controllable damper blades in response to a user-initiated instruction, or in response to detecting feedback from one or more pressure sensors.

In such embodiments, the air control system 114 can provide a user with control over whether patient chamber 104*a*, 104*b* is operating as a negative pressure chamber, a positive pressure chamber, or as a neutral pressure chamber as well as transitions between any of two of these pressure conditions, regardless of the ambient pressure outside of the chambers 104*a*, 104*b*, by controlling the airflow into and out of the chambers 104*a*, 104*b*.

For example, if the user wishes for the patient chamber 104*a* to maintain a negative air pressure, the air control system 114 can be instructed/controlled to control the valves of dampers 118*a*1 and 118*a*2 so that a higher CFM of air is being conveyed out of the patient chamber 104*a* than is being conveyed into it (i.e., the outlet rate is greater than the inlet rate). In particular, damper 118*a*1 may be angled to permit passage of air at a first airflow rate, such as only about 170 CFM), while damper 118*a*2 is angled to permit passage of air at a second airflow rate which is larger than the first airflow rate and so the second airflow rate may be about 245 CFM. Various levels of inlet and outlet flows may be achieved, while still maintaining the patient chamber 104*a* at a negative air pressure with respect to the ambient pressure. This may be done by controlling the airflow system 108*a* to change the relative incoming flow rate (i.e., inlet rate) and the outgoing flow rate (i.e., outlet rate) without causing the inlet rate of airflow to exceed that of the outlet rate. In one example embodiment, 0.01-0.04 inches WG (e.g., about 3-10 Pascal) negative pressure is available.

For example, in at least one embodiment, when the user input indicates that a negative air pressure configuration is selected, then the inlet rate may be set to be less than the outlet rate. In such cases, the range of negative pressure that may be achieved within the room may vary from 270 cfm to 250 cfm when the room is about 96" wide×144" long×84" tall in size, the HVAC is about 2-ton cooling with 5 KW heating in size and the HEPA units are about 280 cfm rated in size. For example, in at least one embodiment, the pressure in the negative pressure configuration may be about at least 0.01 Water Column (WC).

Alternatively, if the user/operator wishes for the patient chamber 104*b* to maintain a positive air pressure, the air control system 114 can control the electrically controllable valves of dampers 118*b*1 and 118*b*2 so that a higher CFM of air is being conveyed into the patient chamber 104*b* than out of it. In particular, damper 118*b*1 may be angled to permit an inlet rate at a third rate of about 245 CFM, while the damper 118*b*2 is angled to permit an outlet rate at a fourth rate that is less than the third airflow rate and may be set at only about 170 CFM, for example. Various levels of inlet and outlet flows may be achieved, while still maintaining the patient chamber 104 at a positive air pressure with respect to the ambient pressure. This may be done by controlling the airflow system 108*b* to change the relative inlet rate and outlet rate without causing the outlet rate to exceed the inlet rate.

For example, in at least one embodiment, for a hospital or medical room environment, for the positive pressure configuration the pressure differential between the room and its external environment may be greater than +2.5 Pa (0.01 inches water gauge) or preferably greater than +8 Pa, there can be 12 or more air changes per hour and the filtration efficiency may be 99.97% @ 0.3 μm DOP. As another example, for a hospital or medical room environment, for the negative pressure configuration the pressure differential between the room and its external environment may be greater than-2.5 Pa (0.01 inches water gauge), there can be 12 or more air changes per hour and the filtration efficiency may be 90% (dust spot test) on the supply and 99.97% @ 0.3 μm DOP on the return. In general, the larger the room the faster the CFM to match the pressure condition and it is opposite for smaller rooms. For use in other situations such as, but not limited to, classrooms or long-term care, for example, other operating parameters can be used for pressure, air exchanges and/or filtration efficiency as required.

Furthermore, if the user/operator wishes for the patient chamber 104*a* to maintain a neutral air pressure, the air control system 114 may be configured to control the electrically controllable valves of dampers 118*a*1 and 118*a*2 so that the same CFM of air is being conveyed into the patient chamber 104 as is being conveyed out of it (i.e., the inlet rate substantially matches the outlet rate). For example, the damper 118*a*1 may be angled to permit an inlet rate of about 245 CFM, while the damper 118*a*2 is angled to permit an outlet rate of about 245 CFM. Various volumes of inlet and outlet flow may be achieved, while still maintaining the patient chamber 104*a* at a neutral air pressure with respect to the ambient pressure. This may be done by enabling a user to control the airflow system 108*a* to increase or decrease the inlet rate and outlet rate in unison so that none of them persistently exceeds the other.

In at least one embodiment, the HEPA filter units 116*a*1, 116*a*2, 116*b*1, 116*b*2 may be rated to provide a certain amount of air exchanges, such as at least twelve (12) air exchanges per hour. Alternatively, in some embodiments, the HEPA filter units 116*a*1, 116*a*2, 116*b*1, 116*b*2 may be controlled to provide about thirty (30) air exchanges per hour. If fewer air exchanges are used, the air control system 114 may control the blades of the damper units 118*a*1, 118*a*2, 118*b*1, 118*b*2 so that a lower volume than 245 CFM is being conveyed into or out of the patient chamber 104*a*, 104*b*. In at least one alternative embodiment, depending at least on air pressure conditions and chamber sizing, the HEPA filter units 116*a*1, 116*a*2, 116*b*1, 116*b*2 can be sized to provide a minimum of 12 air exchanges per hour up to about 30 air exchanges per hour depending on the size of the HVAC systems 109*a*, 109*b*. The required air exchanges and the size of the room with which the air control system is used dictates the size of the HEPA CFM. For instance, the larger the room for a given air exchange requires more CFM. As an example, in an ICU chamber, in a negative pressure configuration, the inlet air may be set to be 30% less CFM than the outgoing exhaust, thus allowing for about 12-15 air exchanges depending on the size of the chambers 104*a*, 104*b* and the HEPA system. It should be noted that when air exchanges are made using the air control systems described herein, the air exchange may be done to exchange 100% of the air in a room with new incoming filtered air.

The exact inlet and outlet rates that are used will depend on a number of parameters of the patient chamber of the unit 100. These parameters may include one or more of the volume of the patient chambers 104*a* and 104*b*, the number of air exchanges per hour, the relative pressure difference between the external environment and each patient chamber 104*a*, 104*b*, and the leakage area of each patient chamber 104*a*, 104*b*. For example, if the volume of the patient chamber 104*a*, 104*b* is increased, the inlet rate and outlet rate may be increased to maintain the same number of air exchanges per hour. If the leakage area of patient chamber 104*a*, 104*b* is increased, the difference between the inlet rate and outlet rate may be increased to overcome increased pressure losses. If the relative pressure between the external environment and each patient chamber 104*a*, 104*b* is increased in magnitude, the difference between the inlet rate and outlet rate may increase to overcome increased pressure losses. If the number of air exchanges required per hour is increased, both the inlet rate and outlet rate will need to be increased. In at least one embodiment, other factors may affect the inlet rates and outlet rates that are used to obtain and maintain a certain pressure condition. These factors may include one or more of friction, airflow patterns, air density and air temperature changes.

In at least one alternative embodiment, alternative HEPA filter units may be deployed that have been equipped with variable speed drives, obviating the need to separately control dampers 118 since a user is able to directly control motor speed for these alternative HEPA filter units.

For example, in at least one alternative embodiment, the air inlet subsystem 110 and air outlet subsystem 112 each comprise a HEPA filter unit that is equipped with a variable speed drive. The various air flow systems in these embodiments are similar to what is shown in FIG. 4A except there are no damping units since the HEPA filter units that are used have variable speed drives.

In this embodiment, the air pressure control system 114 can be configured such that each patient chamber 104*a*, 104*b* is operating independently of one another at positive pressure, negative pressure, or neutral pressure relative to the ambient environment. When a user configures the air pressure control system 114 to set the chamber 104*a* to positive pressure, the air pressure control system 114 directs the HEPA filter units of air inlet subsystem 110*a* and air outlet subsystem 112*a* to adjust both the inlet rate and outlet rate by adjusting the speed at which the variable speed drive of each HEPA filter unit is operating. The variable speed drive of the HEPA filter unit of the air inlet subsystem 110*a* may be adjusted such that the inlet rate is at a first flow rate such as about 245 CFM, for example, while the variable speed drive of HEPA filter unit of air outlet subsystem 112*a* may be adjusted such that the outlet rate is at a second flow rate that is less than the first flow rate, so the second flow rate may be at about 170 CFM, for example. As the inlet rate is greater than the outlet rate, the patient chamber 104 is operating at a positive pressure configuration.

Similarly, when a user configures the air pressure control system 114 to set patient chamber 104*b* to negative pressure, the air pressure control system 114 directs the HEPA filter units of air inlet subsystem 110*b* and air outlet subsystem 112*b* to adjust both the inlet rate and outlet rate, respectively, by adjusting the speed at which the variable speed drive of each of these HEPA filter units are operating. The variable speed drive of the HEPA filter unit of air inlet subsystem 110*b* may be adjusted such that the inlet rate is at a third rate such as 170 CFM, for example, while the variable speed drive of HEPA filter unit of the air outlet subsystem 112*b* may be adjusted such that the outlet rate is at a fourth airflow rate that is higher than the third airflow rate and may be at about 245 CFM, for example. As the inlet rate is less than the outlet rate, the patient chamber 104*b* is operating at a negative pressure configuration.

When a user configures the air pressure control system 114 to set patient chamber 104*a* to neutral pressure, the air pressure control system 114 directs the HEPA filter units of air inlet subsystem 110*a* and air outlet subsystem 112*a* to adjust both the inlet rate and outlet rate by adjusting the speed at which the variable speed drive of each HEPA filter unit is operating. The variable speed drive of the HEPA filter unit of air inlet subsystem 110*a* may be adjusted such that the inlet rate is at a fifth airflow rate such as about 245 CFM, for example, while the variable speed drive of the HEPA filter unit of air outlet subsystem 112*a* may be adjusted such that the outlet rate is at a sixth airflow rate which is about the same as the fifth airflow rate at about 245 CFM. As the inlet rate substantially matches the outlet rate, the patient chamber 104*a* is operating at a neutral pressure configuration, wherein the pressure inside patient chamber 104 is substantially equal to the pressure of the environment outside of mobile medical unit 100.

In other examples and situations, the air inlet subsystem 110 and the air outlet subsystem 112 may be configured such that the inlet rate and outlet rate differ from the example values given above.

In the example embodiment of FIGS. 1 to 4, the exterior of the unit 100 is the external environment. Accordingly, if the mobile medical unit 100 is placed outdoors, the exterior may be defined as the outdoor atmosphere. The air drawn into the inlet subsystems 110*a*, 110*b* will be sourced from the outdoor atmosphere. If the unit 100 is placed in a large indoor environment, such as a warehouse or aircraft hangar, the air drawn into the inlet subsystems 110*a*, 110*b* will be sourced from the air within the large indoor environment.

As previously described, in other examples, the airflow system may be applied to other semi-permanent or permanent structures. The semi-permanent or permanent structure may comprise a plurality of rooms. The airflow system may be installed into a single room of the plurality of rooms. In such situations, the air drawn into the inlet subsystems 110*a*, 110*b* may be sourced from either the environment external to the semi-permanent or permanent structure, or from another room of the semi-permanent or permanent structure.

The airflow system may be retrofitted into a room of an existing semi-permanent or permanent structure with multiple rooms. In such examples, the room which the airflow system is to be integrated into may comprise an HVAC air inlet and air return outlet. The integration of existing structure HVAC equipment may or may not be appropriate depending on the exact configuration of the HVAC equipment. For example, some HVAC systems may recirculate return air from multiple rooms into the HVAC air inlet of the multiple rooms. This may be problematic from a sterility standpoint, as return air from one room may be supplied into another room, without filtration, circumventing the filtration system of the airflow system.

Accordingly, in at least one embodiment, in a room comprising an HVAC air inlet and air return outlet, the HVAC air inlet and return outlet may be blocked or otherwise disabled. The airflow system described herein may be integrated into the room, wherein the flow into the room is exclusively through air inlet subsystem 110, while the flow out of the room is exclusively through air outlet subsystem 112. In such example embodiments, the air inlet subsystem 110 may source air from another room within the permanent or semi-permanent structure. This air may already be pretreated by the building HVAC system, and therefore, may be at the desired temperature and humidity level. If the air was alternatively sourced from the external environment, the air may be at an uncomfortable temperature during certain times of year and may be further warmed or cooled. The air outlet subsystem 112 may deposit air either into another room of the semi-permanent or permanent structure, or to the environment external to the semi-permanent or permanent structure depending on, for example, whatever is more convenient.

In at least one other example embodiment, in a room of a semi-permanent or permanent structure comprising an HVAC air inlet and air return outlet, the HVAC return outlet may be blocked or otherwise disabled, while the HVAC air inlet into the room is left operational. The air inlet subsystem 110 may source intake air from either the environment external to the semi-permanent or permanent structure, or another room within the semi-permanent or permanent structure. The air outlet subsystem 112 may expel outlet air to the environment external to the semi-permanent or permanent structure or to another room within the semi-permanent or permanent structure. In such example embodiments, the structure's HVAC system may condition (e.g., pre-treat) the air within the room which the airflow system is installed into. The air inlet subsystem 110 may be placed near the HVAC air inlet, such that the air stream deposited into the room by the air inlet subsystem 110 substantially mixes with the air stream deposited into the room by the HVAC air inlet. The HVAC air inlet will provide temperature and humidity conditioned air, allowing the air inlet subsystem 110 to source air that may not be at an appropriate temperature and or have an appropriate humidity for an indoor environment, such as air sourced from the external environment during the winter season. Such a configuration may be used in cases where the structure's HVAC system is sized appropriately such that it may provide conditioned air at a rate matching or surpassing the rate of air provided by air inlet subsystem 110. Additionally, the use of the structure's HVAC system may be appropriate wherein the output from the HVAC system is sufficiently sterile. If the HVAC system recirculates outlet air from other areas of the structure, depending on the quality of the air, modifications may be made to the HVAC system, such as including additional filtration.

Figure 7B:
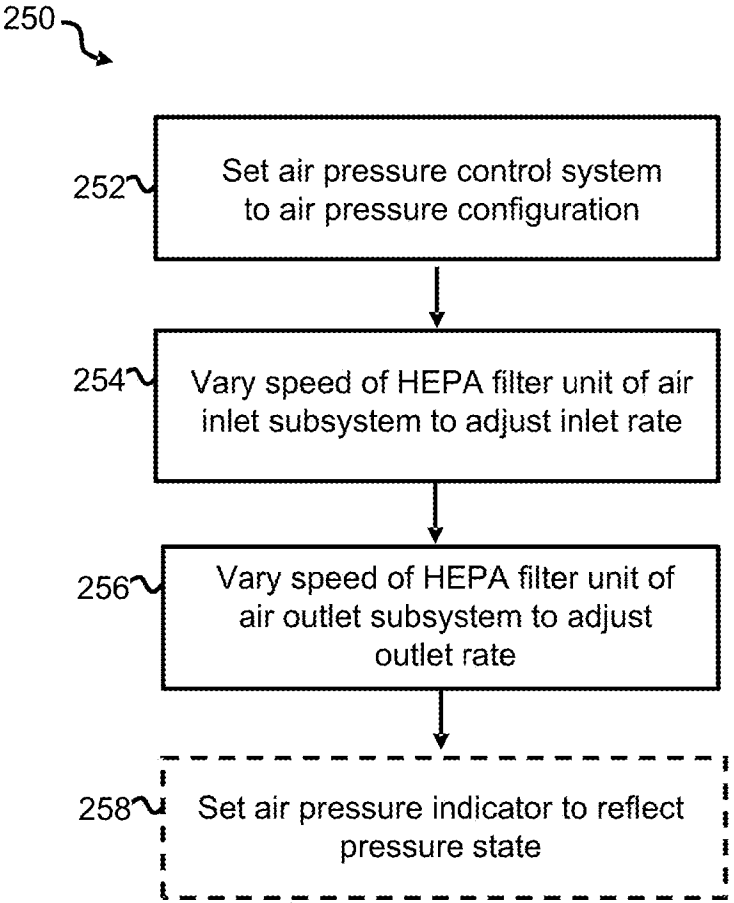
FIG. 7B is a flow chart showing an example embodiment of an alternative method of configuring the mobile medical unit of FIGS. 1 to 6.
Figure 7A:
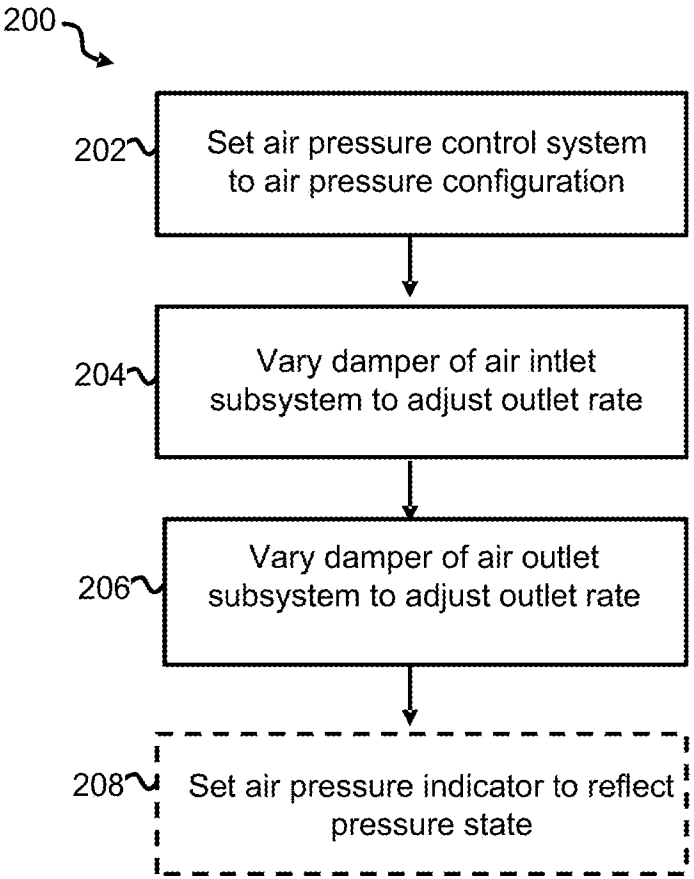
FIG. 7A is a flow chart showing an example embodiment of a method of configuring the mobile medical unit of FIGS. 1 to 6.

Referring now to FIG. 7A, shown therein is a flow chart illustrating an example embodiment of a method 200 of configuring a room or chamber of a portable, semi-permanent or permanent structure, such as a mobile medical unit, for example, to operate in a desired air pressure configuration, where the airflow system 108 comprises a HEPA filter unit and a damper unit. The description above in reference to FIGS. 1 to 6 describing various embodiments of the mobile medical unit 100 may also apply to method 200.

Method 200 begins with step 202 where the air pressure control system 114 is set to achieve a desired air pressure configuration in a room. The air pressure control system 14 may be adjusted, or interfaced with, using the input interface 122 described above, for example, by allowing a user to select an air pressure configuration. In at least one example embodiment, the air pressure configuration may be selected by allowing the user to control a discrete pressure setting such as positive pressure, negative pressure or neutral pressure. In such cases, the positive pressure and negative pressure may be at a predefined level relative to neutral pressure or the ambient pressure of an environment that is external to the room, such as a preset pressure difference that is positive or negative relative to the ambient pressure. Alternatively, or in addition thereto, the air pressure configuration may be selected by allowing a user to select from varying levels of positive pressure or negative pressure. For example, a user may select a positive or negative pressure of 0.01 to 0.06 inches of water relative to the external environment. The air pressure configuration may further comprise a predefined absolute positive or negative pressure.

At step 204, the air pressure control system 114 adjusts the inlet rate by varying the valve position of the damper unit associated with the air inlet subsystem 110, until the desired inlet rate is reached. Step 204 may be conducted using open loop or closed loop control. In a closed loop control scheme, the valve position of the damper unit 116 is varied until the flow rate measured by flow meter 134 matches the desired inlet rate. In an open loop control scheme, the damper unit 116 is set to a desired position, that is predetermined to correspond to a certain inlet rate.

At step 206, air pressure control system 114 adjusts the outlet rate by varying the valve position of the damper unit 118 associated with the air outlet subsystem 112, until the desired outlet rate is reached. Step 206 may be conducted using open loop or closed loop control. In a closed loop control scheme, the valve position of the damper unit 118 is varied until the flow rate measured by flow meter 134 matches the desired outlet rate. In an open loop control scheme, the valve position of the damper unit 118 is set to a desired position, that is predetermined to correspond to a certain outlet rate.

In at least one embodiment of method 200, step 204 and step 206 may be executed concurrently.

After the completion of step 206, the airflow system 108 of the mobile medical unit is now set to the desired pressure configuration.

Some examples of method 200 may further comprise step 208, wherein the pressure indicator 120 is set to reflect the pressure configuration set at step 202. For example, in embodiments wherein pressure indicator 120 comprises an LED light, air pressure control system 114 instructs the pressure indicator 120 to output a given light color that is associated with the set pressure configuration. For example, when a positive pressure configuration is set at step 202, the pressure indicator 120 may be illuminated in a first color, such as blue and when a negative pressure configuration is set at step 202, the pressure indicator may be illuminated in a second color, such as red. In at least one embodiment, pressure indicator 120 may only reflect a pressure configuration when measurements obtained from pressure sensor 130 also reflect the pressure configuration. For example, when the pressure configuration set at step 202 is a positive pressure configuration, the pressure indicator 120 will only reflect a positive pressure condition when measurements obtained from pressure sensor 130 reflect a positive pressure condition.

Referring now to FIG. 7B, shown therein is a flow chart illustrating an example embodiment of a method 250 of configuring a room or chamber of a portable, semi-permanent or permanent structure, such as a mobile medical unit for example, to operate in a desired air pressure configuration, wherein the airflow system comprises a HEPA filter unit with a variable speed drive. The description above in reference to FIGS. 1 to 6 describing various embodiments of the mobile medical unit 100 may also apply to method 250.

Method 250 begins with step 252 where the air pressure control system 114 is set to control the air pressure of the room to be at a desired air pressure configuration. The air pressure control system 114 may be adjusted or interfaced with as described in step 202 of method 200 and the air pressure configuration can have various settings as described in step 202 of method 200.

At step 254, the air pressure control system 114 adjusts the inlet rate by varying the speed of the HEPA filter unit associated with the air inlet subsystem 110, until the desired inlet rate is reached. Step 254 may be conducted using open loop or closed loop control. In a closed loop control scheme, the speed of the HEPA filter unit is varied until the flow rate measured by flow meter 134 matches the desired inlet rate. In an open loop control scheme, the speed of the HEPA filter unit is set to a desired speed, that is predetermined to correspond to a certain inlet rate.

At step 256, the air pressure control system 114 adjusts the outlet rate by varying the speed of the HEPA filter unit 116 associated with the air inlet subsystem 110, until a desired outlet rate is reached. Step 256 may be conducted using open loop or closed loop control. In a closed loop control scheme, the speed of the HEPA filter unit is varied until the flow rate measured by flow meter 134 matches the desired outlet rate. In an open loop control scheme, the speed of the HEPA filter unit is set to a desired speed, that is predetermined to correspond to a certain outlet rate.

In at least one embodiment of method 250, steps 254 and 256 may be executed concurrently.

After the completion of step 256, the airflow system 108 of the mobile medical unit is now set to the desired pressure configuration.

Some examples of method 250 may further comprise step 258, wherein the pressure indicator 120 is set to reflect the pressure configuration set at step 252. For example, in embodiments wherein pressure indicator 120 comprises an LED light, air pressure control system 114 instructs the pressure indicator 120 to output a given light color associated with the set pressure configuration as was described in step 208 of method 200.

It should be understood that while the description of the methods 200 and 250 is with respect to controlling air pressure configuration for one room, the methods 200 and 250 may be used to selectively control the air pressure configuration for at least two rooms independently of one another by selecting control settings for each room where the settings may be the same or different and sending control signals to the controllable air flow components (e.g. HEPA filter units, dampers, etc.) of the different rooms where the control signals are generated according to the selected control settings so that the control signals achieve the desired pressure configuration in the two or more rooms.

In instances of the methods 200 and 250, the air pressure control system 114 may be set to a positive pressure configuration where the inlet rate is greater than the outlet rate, or the air pressure control system 114 may be set to a negative pressure configuration where the inlet rate is less than the outlet rate, or the air pressure control system 114 may be set to a neutral pressure configuration where the inlet and outlet rates are substantially equal.

In at least one embodiment described herein, the unit 100 or other rooms of the various structures described herein that incorporate the airflow control system and may be used in semi-permanent, or permanent compound structures of various configurations, may be fully insulated to provide reliable operation within temperatures ranging from about −50° C. (−58° F.) to about 50° C. (122° F.). Temperature controls may be used within such rooms such that whatever the outdoor season, there is no temptation to open a door/window and/or frustration at being unable to do so.

In this description, the interior walls, the exterior walls, the roofing structure, and the ceiling of the mobile unit 100 and other structures described herein may be formed with powder-coated, marine grade aluminum or metal panels. For example, H52 marine grade aluminum may be used. Marine grade material may also provide corrosion resistance and can tolerate even constant contact with seawater. Alternatively, in at least one embodiment, these structural elements may be formed of any metal such as, but not limited to, for example, A36, 44W, any other suitable ASTM grades or carbon-based thermoplastic materials.

In at least one embodiment, a vapour barrier film may also be included in the units 100 and used to control condensation and may be applied between at least one of the wall panels or at least one of the ceiling panels and the interior surfaces of the side walls or the roof of the housing of the shipping container 102. In such cases, the vapour barrier film may be sprayed onto the surfaces where condensation may otherwise form.

Figure 8A:
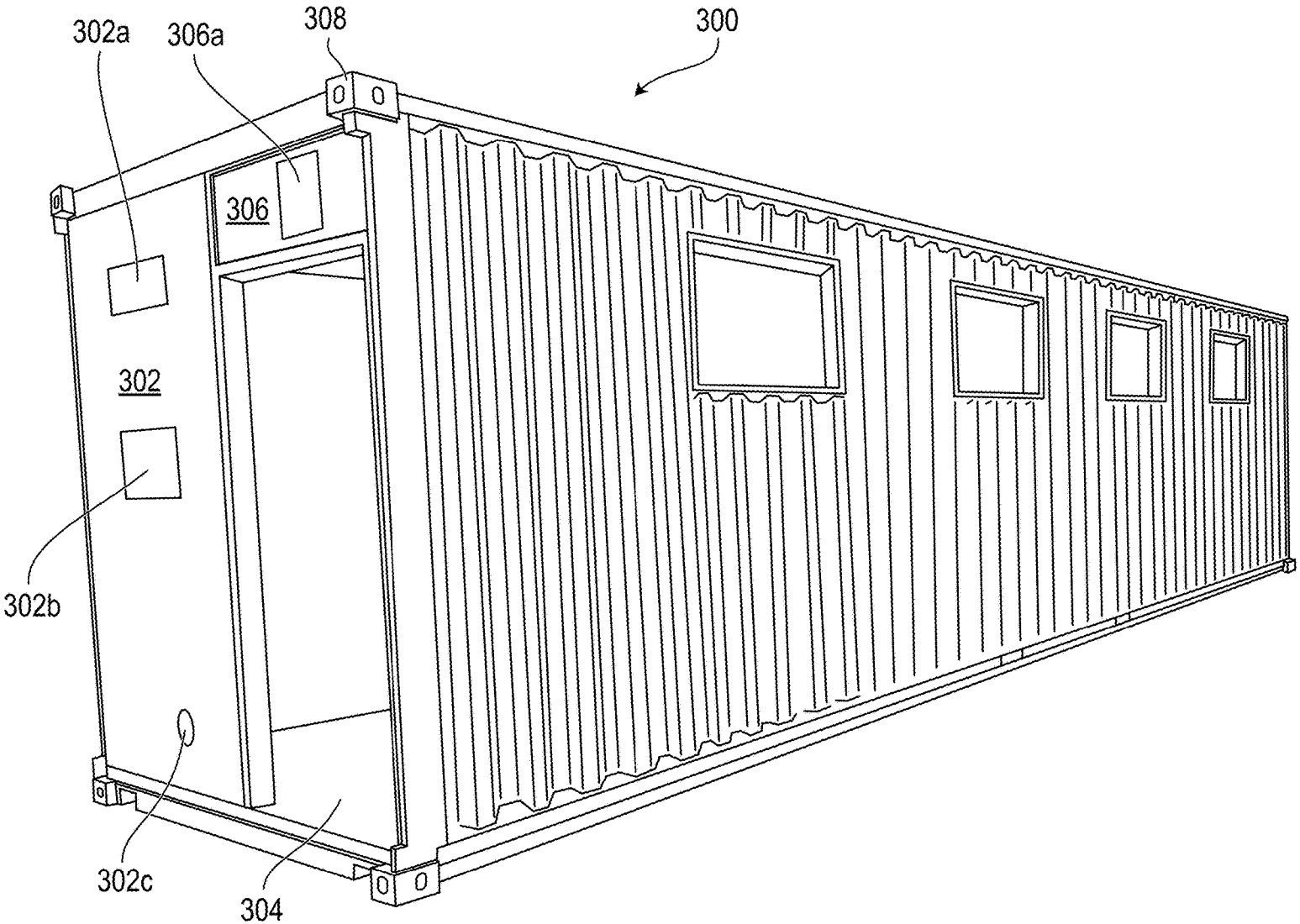
FIG. 8A is a perspective view showing the front and a first side of a shipping container modified to serve as the basis for a mobile medical unit, according to an example embodiment.

Referring now to FIG. 8A shown therein is a perspective view showing the front and a first side of a shipping container 300 modified to serve as the basis for a mobile medical unit, such as unit 100, according to an example embodiment. In this view, the panel 302 against which the HVAC equipment box is to be mounted is shown beside the doorway 304. The panel has openings 302*a* and 302*b* for the HVAC inlet and return, as well as a lower vent 302*c* opening for air exiting from the mobile medical unit. A panel 306 on which the inlet vent 306*a* can be mounted is shown above the doorway 304.

Shown at the corners of the shipping container 300 are standard blocks 308, which can be referred to as corner castings or isocorners, with openings for facilitating the receipt of clamps or fasteners for the clamping-together of multiple shipping containers (serving, in this description, as mobile medical units, anteroom units, nurse station units, hallway units, connector units, class room units or other types of units) that are placed and secured adjacent to each other to form compound structures. Only one of the corner castings 308 is labelled for ease of illustration. These compound structures may be portable, semi-permanent or permanent structures.

Figure 8B:
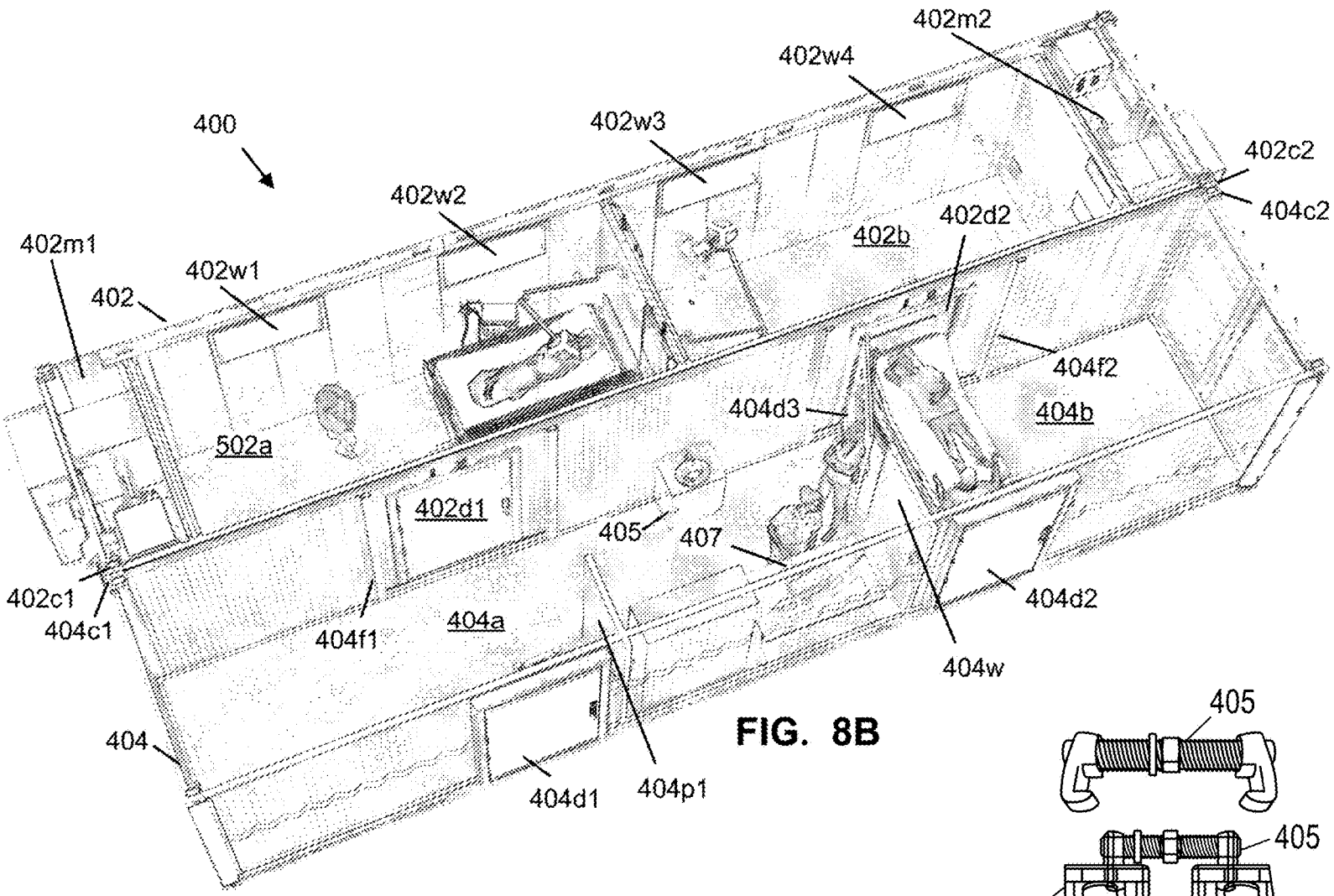
FIG. 8B is a top perspective view of an example embodiment of a compound structure including a mobile medical unit that is connected with another mobile unit that is itself equipped as a nurse station, thereby to form a compound structure, according to the construction techniques and air control system described herein.
Figure 8C:
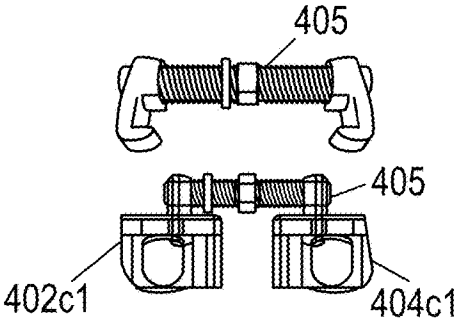
FIG. 8C is a perspective view of interlock components for coupling two portable units together.

Referring now to FIG. 8B, shown therein is a top perspective view of a compound structure 400 that includes a medical unit 402 that is connected with another mobile unit 404 that is itself equipped as a nurse station 406, according to an example embodiment. In this example embodiment, the mobile medical unit 402 is similar to the medical unit 100 of FIGS. 1-4 and is divided into two halves each with its own patient chamber 402*a* and 402*b* and respective maintenance rooms 402*m*1 and 402*m*2. The nurse station unit 404 is placed adjacent to the mobile medical unit 402 and is held together with the mobile medical unit 402 to form the compound structure 400 using clamps or other suitable fasteners linking the shipping containers' corner blocks 402*c*1 and 404*c*1 together as well as corner blocks 402*c*2 and 404*c*2 together. An example of the fastening of the corner blocks 402*c*1 and 404*c*1 using clamp 405 is shown in FIG. 8C.

In this example embodiment, the nurse station unit 404 itself is constructed based on a shipping container that is the same size as that of the mobile medical unit 402 but is configured to have different interior features than the mobile medical unit 402. In this example embodiment, the nurse station unit 404 itself has two exterior doorways with respective doors 404*d*1 and 404*d*2, half-wall divider or partition 404*p*1, half-wall 404*w* and internal door 404*d*2, which generally partitions the unit 404 into room 404*a* and room 404*b*, which may serve as another patient room. In room 404*b* there can be various patient setups, and in this example, there is a patient bed. A person can get into the patient room 404*b* via the internal door 404*d*3 or the external door 404*d*2. The unit 404 can have a variety of internal setups including, but not limited to, various pieces of furniture including a cabinet, and a desk for a nurse's station 406, and a portable handwashing station 407. The nurse unit 404 may be fitted with at least one independent HVAC unit (not shown) for air conditioning within the nurse unit 404.

The nurse unit 404 also features two additional doorways 404*f*1 and 404*f*2 that may optionally be opposite the exterior doors 404*d*1 and 404*d*2. The doorways 404*f*1 and 404*f*2 respectively face doors 402*d*1 and 402*d*2 of the mobile medical unit 402. In this way, the doors 402*d*1 and 402*d*2 of the unit 402 may be opened outwards and into the nurse unit 406 when required.

In this example embodiment, each doorway (i.e., door frame) 404*f*1 and 404*f*2 of the nurse unit 404 is larger in height and width than the corresponding door 402*d*1 and 402*d*2 of the mobile medical unit 402. Each doorway 404*f*1 and 404*f*2 of the nurse unit 406 includes a frame with an outward-facing planar surface that faces and runs parallel to a corresponding outward-facing planar surface that is a portion of the exterior wall of the unit 402 which is around the doors 402*d*1 or 402*d*2 of the mobile medical unit 402. The outward-facing planar surface portions of the mobile medical unit 402 faced by and adjacent to the outward-facing surface portions around the frames of the doorways 404*f*1 and 404*f*2 of the nurse unit 406 are planar or in other words have a flat pattern. Because these surface portions of the units 402 and 404 face are adjacent one another the foam seal is placed on these flat surfaces which are then urged towards each other due to the clamping of the corner blocks which will aid in forming a seal around the doors 402*d*1 and 402*d*2 as the rooms 402*a* and 402*b* may be at a positive pressure or a negative pressure relative to the nurse unit 404 as explained previously for unit 100. The widths and thickness of the planar or flat pattern surfaces that are adjacent to one another are dimensioned to be wide enough (e.g., at least about 6 inches) and thick enough to withstand the compression forces when they are pushed together as the shipping containers are clamped and urged together.

In this example embodiment, prior to bringing the two shipping containers for unit 402 and 404 physically together, seals are provided between of each of the larger openings between the surfaces of the two units 402 and 404 that face one another. For example, since doorways 404*f*1 and 404*f*2 are larger than the opposing doors 402*d*1 and 402*d*2, respectively, seals can be positioned so that they will be at and/or around the portions of the doorways 404*f*1 and 404*f*2 of unit 404 that will make contact with an opposing surface of the unit 402. In some embodiments for compound structures, when two shipping containers are urged together and the entirety or a majority of the walls that would otherwise be adjacent to one another are removed then the seal may be sized and disposed to be between the entire frames of the shipping containers that are adjacent to one another.

In at least one embodiment, the seal may be a frame-shaped body of neoprene rubber foam having a sufficient thickness such as, but not limited to, about two (2) to three (3) inches, or about 2.5 inches in thickness and about two (2) to three (3) inches wide. Alternatively, in at least one embodiment, the seal may be a closed cell foam having similar dimensions. The closed cell foam has holes, but they are not connected so that water, fluid, or other gas does not pass through this foam as they would for a sponge. The holes in the closed cell foam allow the foam to be more compressible as well to increase the amount of sealing that is provided. In applying the foam seal, two adjacent shipping containers are coupled and urged or pressed together which will compress the foam. After the two adjacent shipping containers are no longer moved towards one another, the foam will start to expand and create a tighter seal.

In at least one embodiment the seal may be adhered to either to a surface portion of the mobile medical unit 402 or a surface portion of the nurse station unit 504 at and/or around the frames of doorways 404*f*1 and 404*f*2 before bringing the two shipping containers physically together. Alternatively, the seal may be held in place as the two shipping containers are being brought together. As the two shipping containers are brought together in alignment, the frames of the mobile medical unit and the nurse station module are brought into alignment. As the two shipping containers are urged closer together, by increasing the clamping force at the corner casting blocks 402*c*1 and 404*c*1 as well as 402*c*2 and 404*c*2, the seal is increasingly compressed between the adjacent surfaces of the units 402 and 404 that contact one another thereby serving as a gasket for providing a fluid-tight seal around the frames of the doorways 404*f*1 and 404*f*2. In this way, air exiting the mobile medical unit 402 via the opening of door 402*d*1 and 402*d*2 from a patient chamber 402*a* or 402*b* can exit only into the nurse station unit 404, and air exiting the nurse station unit 404 via these doors can exit only into a patient chamber. That is, such air cannot escape between the shipping containers themselves.

Accordingly, in at least one embodiment the seal goes around the entire frame of the shipping container and may only be around the openings of the containers that face one another. Thus, any snow or water that falls on the shipping containers may flow between the shipping containers and around the portions of the shipping containers that are sealed together rather than just settling on top of the roofs of the shipping containers if the frames of the shipping containers were sealed to each other. Any rain or snow sitting on the roof of a shipping container may increase the likelihood of fluid leakage to the interior of the units which may cause damage.

It will be appreciated that, in embodiments described herein, all of the various doorway interconnections and/or any cut away areas that do not have a window or door in compound structures made with one or more mobile medical units and other modules such as a nurse station module, a hallway module, a connection module, an anteroom module, and some other modules, may be sealed together in the same way with respective frame-shaped gaskets that are compressed to form airtight seals between each of the various modules that may be used to construct a compound structure.

Provision of the fluid-tight seal around the doorway using a thick and at least somewhat rigid material such as neoprene rubber foam or closed cell foam is advantageous in this application. In particular, because the mobile medical units and other modules described herein have patient chambers capable of being flexibly switched between negative, neutral, and positive pressure conditions, the relative rigidity of a frame of neoprene rubber foam, closed cell foam or the like enables it to resist collapsing into, or being blown away from, the doorway it is meant to seal.

Another aspect of the foam seals that can be used in accordance with the teachings herein is that they are more resilient to forces which may be encountered during use. For example, there may be shocks or vibrations or shearing forces that cause the adjacent shipping containers to move relative to one another. Using a compressed foam seal results in the seal being maintained between adjacent shipping containers. This is in contrast with conventional techniques of connecting adjacent shipping containers together which typically involves welding the containers together. These welds are more susceptible to cracking and damage when the above-noted forces are experienced by adjacent connected shipping containers, which will make it problematic to maintain a pressurized seal between the shipping containers.

Furthermore, using a weld to hold adjacent shipping containers together makes it more difficult for the compound structure including these shipping containers from being mobile as the welds will have to be removed in order to move the shipping containers to another location which is time consuming. In contrast, using fasteners to couple adjacent shipping containers together as well as a foam-based seal to maintain a pressurized coupling for orifices of each shipping container that are adjacent to one another, allows for the shipping containers to be more easily decoupled from one another and moved to another location where they may be coupled together and have a pressurized seal between them. This is because such foam-based seals may be removable and reusable.

In this example embodiment, power and data to the nurse station unit 404 may be provided along a twin-male cable extending between the mobile medical unit 402 and the nurse station unit 404. In this manner, the nurse station unit 404 may be powered by the mobile medical unit 402 rather than directly by an external source. Furthermore, the nurse station unit 404 can simultaneously be provided with a data link for conveying audio, video, and other data to and from the mobile medical unit 402. It will be appreciated that wireless communications configurations, such as Wi-Fi, may alternatively, or in addition, be facilitated for communications as between modules and between modules and other locations. This information can be used to monitor the patient, the air quality and the pressure conditions within the patient chambers 402*a* and 402*b*, as well as to control and/or monitor the medical equipment operating within the patient chambers 402*a* and 402*b*. Patients, their families, and the caregivers are able to connect with each other using the communications infrastructure integrated with the mobile medical unit 402 and the nurse station unit 404. For example, doctors and other medical practitioners can communicate with the families of patients from inside. Alternatively, in at least one embodiment, the nurse station unit 404 can optionally receive its power directly from a power distribution source instead of the mobile medical unit 402. It should be noted that this communication and power scheme can be applied to other types of compound structures and is not restricted to medical compound structures or mobile medical units.

Figure 9:
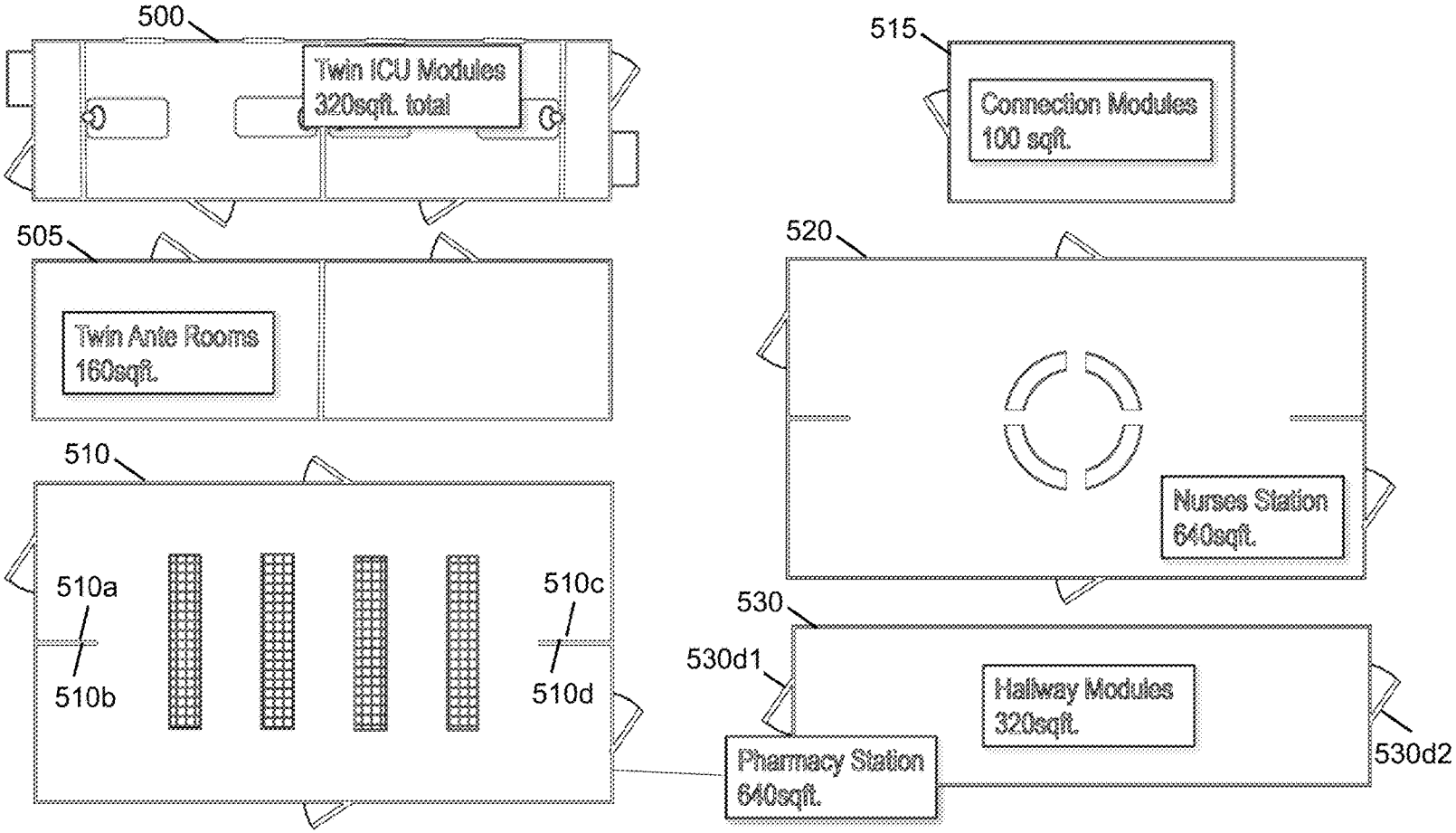
FIG. 9 is a plan view of example embodiments of various portable units including an ante-rooms module, a nurse station module, a hallway module, and a connection module, all suitable for assembling together in various configurations as part of one or more compound structures.

Referring now to FIG. 9, shown therein is a plan view of an individual mobile medical unit 500, an anterooms module/unit 505, a nurse station module/unit 520, a hallway module/unit 530, a connection module/unit 665 and a pharmacy station unit 510, all suitable for assembling in various configurations as part of one or more compound structures. Other formats for these modules/units may be provided to form various different compound structures. Each of the units 500 to 530 may be formed from a single shipping container such as the medical unit 500, the anteroom unit 505 and the hallway unit 530, or from a portion of a shipping container such as the connection unit 515 or may be formed by connecting two shipping containers that are coupled together where a majority of walls that would otherwise be adjacent to one another are removed to form a larger space. A portion of these walls may be retained and coupled to one another such as portions 510*a* and 510*b* as well as portions 510*c* and 510*d* for the pharmacy station unit 510 to increase the structural integrity of the unit 510. Any number of doors may be added to each of the units such as doors 530*d*1 and 530*d*2 for the hallway unit 530. For some of the structures shown in FIG. 9, like the pharmacy station 510, the nurses station 520 or perhaps other large structures such as a Post Anesthesia Care Unit (PACU) (not shown), one or more of the longitudinal support structures, which are described in various embodiments herein such as, but not limited to the embodiments shown in FIGS. 10A-16, may be used to increase the structural integrity of these larger units or stations while trying to reduce the use of internal vertical support structures such as posts, pillar, portions of walls and the like in order to increase free space within these units and structures where free space can be very important.

In another aspect, in accordance with the teachings herein, therein is provided at least one embodiment that provides substantially fluid-tight connections between two or more physically-combined mobile units that together have been assembled to create a compound enclosure or compound structure, with the connections between adjacent mobile units being resilient to pressure conditions inside one of the mobile units, or an individual chamber of a multi-chamber unit within a mobile unit, where the pressure may be changed between negative, positive, or neutral pressure configurations.

In another aspect, in accordance with the teachings herein, there is provided at least one embodiment with structural elements that can be used to assemble various individual mobile units generally having the same or different "types" (i.e., having the same or different layout of physical elements) into various configurations of compound structures that are useful for forming particular custom and scalable configurations of dwellings, classrooms, or any other structures, examples of which are given throughout the description. It should be noted that this technique may be used, in at least some cases, to connect together a custom enclosure with a shipping container to form a compound structure.

The principles of construction, interconnection and deployment of mobile units described herein may be applicable to many other applications. For example, long term care facilities can be formed from arrays of mobile units, including rooms, passages and the like, according to the teachings described herein. Other examples include domestic dwellings, research facilities, laboratories, remote hotels, remote communities, and other kinds of useful sheltering and workplace constructs can be formed from individual mobile units (also known as mobile modules), and/or arrays of interconnected or partly-interconnected mobile units, using the principles described herein. Furthermore, mobile units may be deployed for social housing, safe injection sites, community development in remote locations, quarantine sites, remote shelters for mining and oil and gas industries, and the like.

As another example, mobile modules may be deployed as testing or product delivery sites, enabling vehicles to drive alongside to have its occupants medically tested or to receive products without the occupants necessarily having to leave their vehicles, as temporary gatehouses as shelter for those who are monitoring entryways to restricted areas, as site construction offices, as military command centres, barracks and/or supply rooms, and the like.

In one aspect, in accordance with the teachings herein, there is provided at least one embodiment, which in this example is a classroom or an array of classrooms, which may be constructed from the mobile units described herein. The classroom is given as one example and the teachings related to the classroom can be applied to the other use case scenarios described herein. Such a classroom may be deployed remotely, or as a form of rapid and inexpensive capacity expansion for existing schools.

Figure 10A:
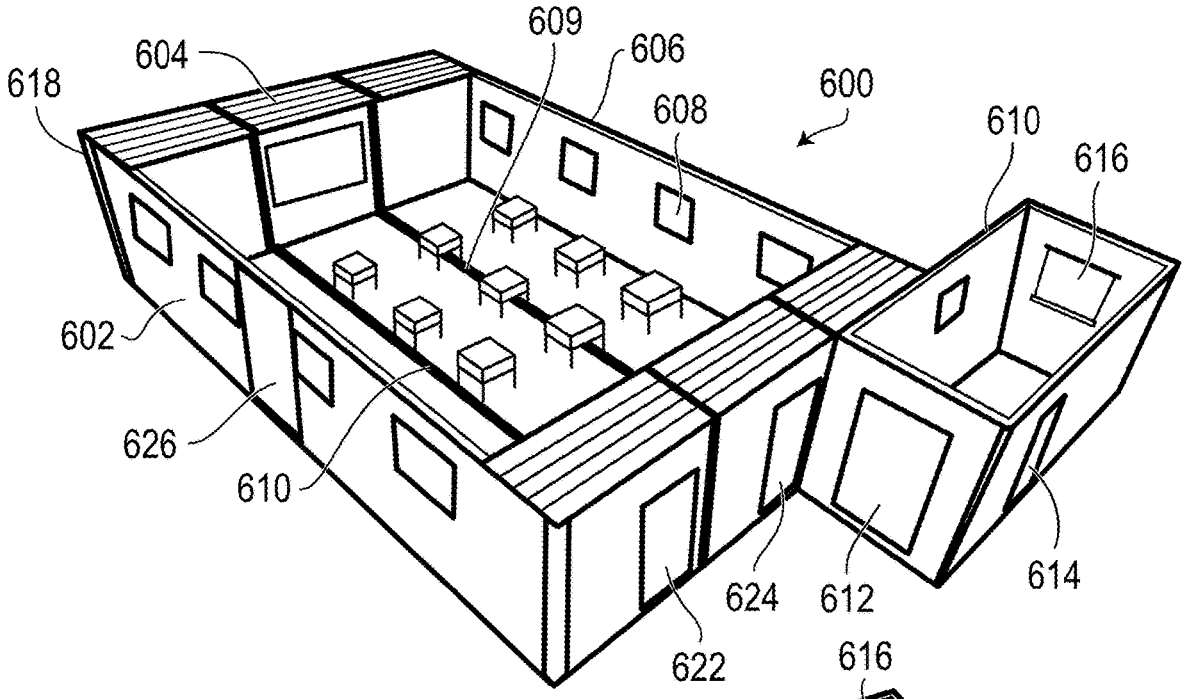
FIG. 10A shows a top perspective cutaway view of a series of mobile units, according to an example embodiment, that have been interconnected to form a single, large room and entryway, suitable for use as a classroom or other larger-group dwelling.
Figure 10B:
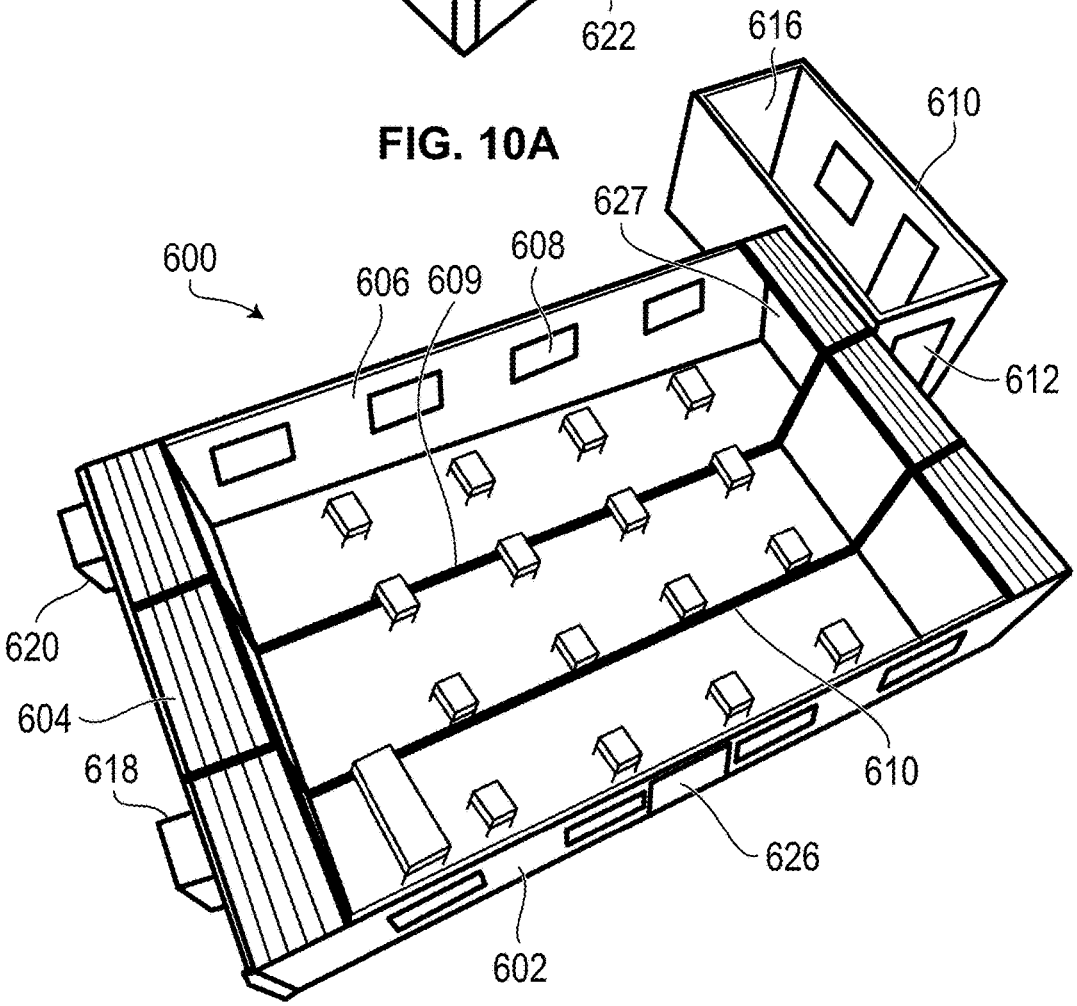
FIG. 10B shows another top perspective cutaway view of the series of mobile units of FIG. 10A.

Referring now to FIGS. 10A and 10B, shown therein are top perspective cutaway views of a series of mobile units, according to one example embodiment, that have been interconnected/assembled to form a compound structure 600 including a single, large room and an entryway, suitable for use as a classroom or other larger-group dwelling. It will be appreciated that the large room is formed by combining the interiors of three mobile units 602, 604 and 606, where the mobile units 602 and 606 have three side walls and open sides 609 and 610 while the mobile unit 604 has only two side walls at its ends (i.e., end walls). It should be noted that the reference numbers 609 and 610 point to seams between the floor structures of the mobile units 606, 604 and 604, 602 where the side walls should have been if they were not removed. The entryway is formed using another mobile unit 610.

It will be appreciated that, according to the mobile unit interconnection principles described herein, compound structures may be formed from two mobile units each having only three side walls, by three or more mobile units in which the outside mobile units have only three side walls while the inside mobile units each have only two end walls, and so forth. Any number of inside mobile units having only two end walls and/or partial side walls may be deployed in such a compound structure, depending on the needs for the size of the room and the available space.

The mobile units 602, 604 and 606 have been assembled laterally with respect to one another with the mobile units 602 and 604 at the sides of the compound structure 600 and the mobile unit 610 acting as an entry/exit passageway including windows 608, one of which is labelled for ease of illustration. However, there may be any number of doors for the compound structures where the mobile unit 610 acting as the passageway having doors 616 and 627 for the main entry and exit points for the compound structure 600. However, some of the other mobile units 602, 604 and 606 may have doors that can act as a quick exit way for emergency purposes like door 626 on a side wall of mobile unit 602.

In addition, as shown in this example, one of more of the mobile units 602, 604 and 606 may also have maintenance rooms to allow for the provision of air conditioning and the like. In this case, the mobile units 602 and 606 have HVAC units 618 and 620 with the associated air handling components that may be implemented as was described with respect to the embodiments shown in FIGS. 3 to 7B, respectively. Mobile units 602 and 604 also have doors 622 and 624 that lead to corresponding maintenance rooms.

Figure 10C:
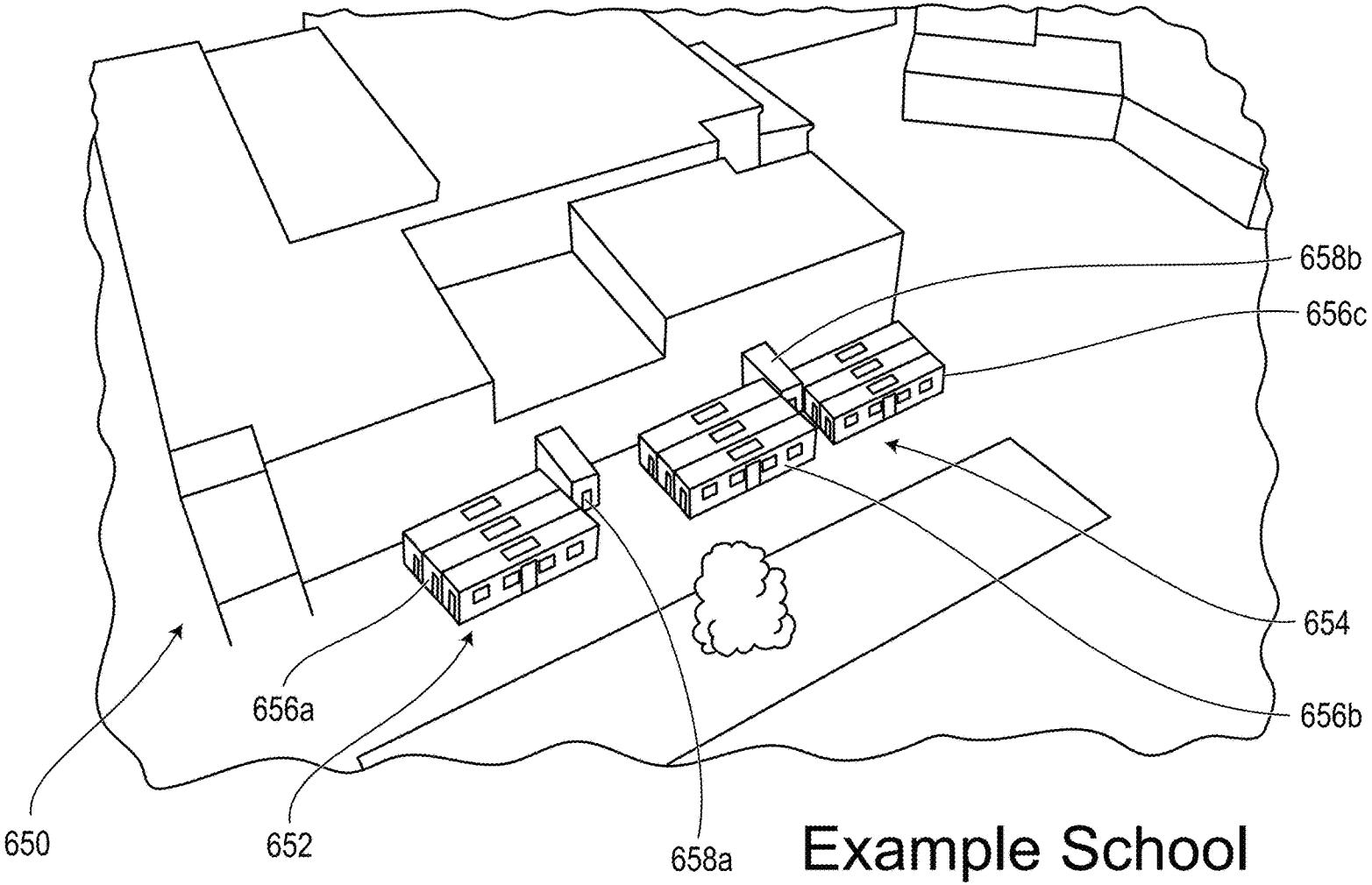
FIG. 10C shows an aerial photo of a fixed school infrastructure, with an example embodiment of multiple mobile units providing passageways from the school into multiple series of units interconnected to form multiple classrooms.

Referring now to FIG. 10C, shown therein is an aerial photo of a fixed school infrastructure, with an example embodiment of multiple mobile units providing passageways, some of which provide passageways from the main school building 650 to, and back from, multiple series of mobile units that are interconnected to form a first compound structure 652 including a first arrangement of mobile units 656*a* and a second compound structure 654 including an array of mobile units including a first arrangement of mobile units 656*b* and a second arrangement of mobile units 656*c*. The first compound structure 652 is connected to the main school building via the mobile unit 658*a* and the second compound structure 654 is connected to the main school building via the mobile unit 658*b*. Each of the mobile units 658*a*, 658*b* act as a hallway or passageway unit and may be similar to the mobile unit 610 shown in FIGS. 10A and 10B. Each of the arrangement of mobile units 656*a*, 656*b* and 656*c* may correspond to the arrangement of mobile units 602, 604 and 606 shown in FIGS. 10A and 10B. Accordingly, the mobile unit arrangements 656*a*, 656*b* and 656*c* are made from several mobile units arranged laterally to one another where the inner or inside mobile units have had their side walls removed so that together each of the mobile unit arrangements 656*a*, 656*b* and 656*c* form larger size enclosures to accommodate larger classroom.

The mobile units depicted in FIGS. 10A-10C can be transported to a site separately but can then be arranged adjacent to each other onsite. A connection structure such as an isocorner (also known as a corner casting) and clamp can bring corners of adjacent mobile units together in a known manner, while a large compressible gasket can be interposed between the facing surfaces of the adjacent mobile units thereby to provide effective moisture-proof sealing between the mobile units once they are clamped together. A gasket surrounds the entire peripheries of the facing mobile units thereby to provide the sealing. Rather than using a gasket other forms of sealing may be used such as neoprene and/or closed cell foams as was described in other embodiments shown herein.

However, it will be appreciated that, with there being less than four side walls for each of the mobile units shown in FIGS. 10A-10C and since the roofs of the individual mobile units that have been brought together to form larger classrooms, supplementary support of the roofs of each of the mobile units is important. This is also important for handling snow load and the load of any equipment or supplies that may need to be placed atop one or more of the mobile units. In addition, when the mobile units that have at least one open side are individually transported, providing support for the roofs of these mobile units is important to avoid damage to the mobile units during transport. The provision of support structures having the required strength and stability may also be challenging when combined with the desire to maximize the internal space of the compound structures that are formed by the assembly of these mobile units. The maximization of internal space can be quite important depending on the usage of the compound structure. In general, the maximization of internal free unencumbered space means not including any internal support structure such as pillars, posts or portions of walls or at least reducing the number of these types of vertical support structures as described below.

Accordingly, in order to maximize the available space within a compound structure that is formed from mobile units while also ensuring that the roofs of the mobile units are provided with enough strength to maintain structural integrity during transport and use, a support structure that is longitudinally oriented along at least a portion of a roof structure of at least one of the mobile units can be incorporated into one or more of the mobile units of the compound structure in a variety of ways as described herein. For compound structures that are very large, these longitudinal roof support structures can still be used which will result in a reduction of the internal vertical structures that are needed thereby still increasing the internal free unencumbered space of the compound structure.

Figure 11A:
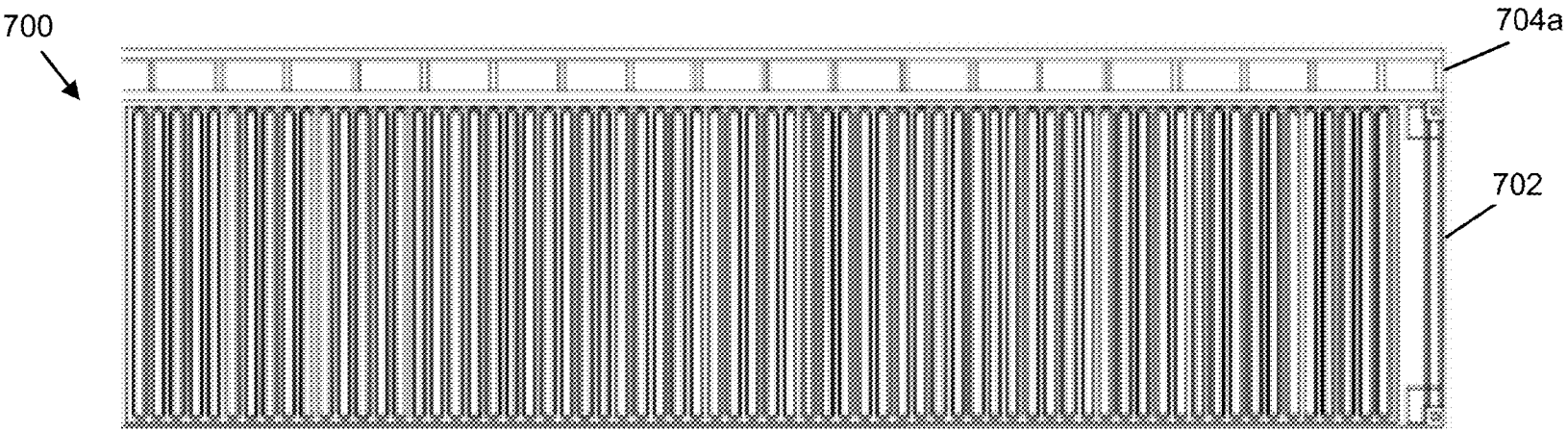
FIG. 11A shows a side elevation view of a mobile unit with a truss structure on its exterior for supporting the roof of the mobile unit along its length, in the absence of a distal wall and/or interior wall or internal support structure.
Figure 11C:
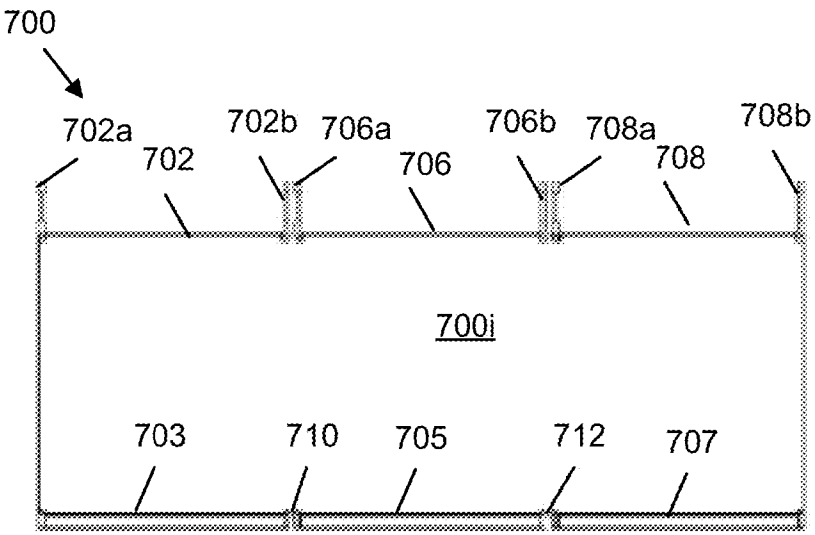
FIG. 11C shows a cross-sectional view of the assembly of three mobile units of FIG. 11B.
Figure 11B:
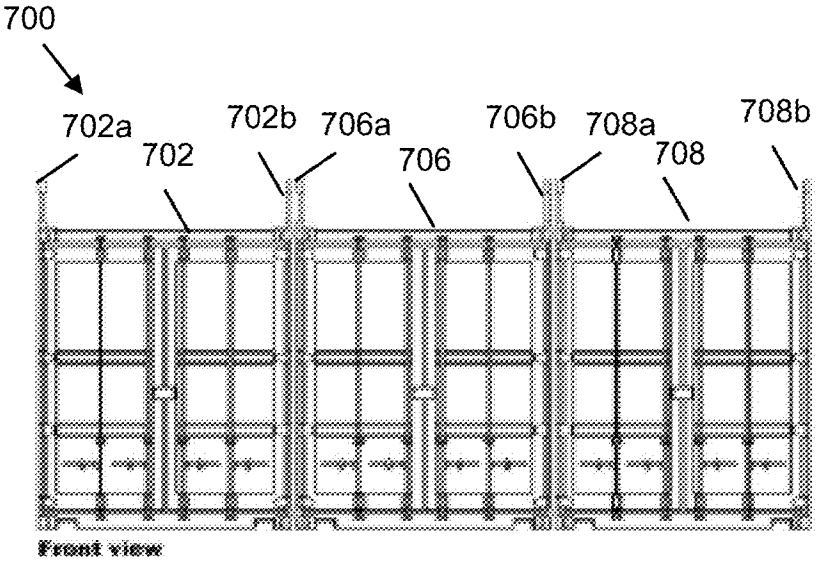
FIG. 11B shows an end view of an example embodiment of an array or series of three mobile units that are assembled laterally, or horizontally offset, to one another and sealingly interconnected to form a single large interior room and having respective roof trusses for supporting their respective roofs in the absence of interior support walls or other interior support structures.

For example, referring now to FIG. 11A-11C, shown therein are various views of a compound structure 700 that is made up of three mobile units 702, 706 and 708 which are assembled in laterally along the longitudinal sides of each of the mobile units 702, 706 and 708. In this example, each of the mobile units 702, 702 and 708 include a support structure for the roof, which in this case are a pair of trusses that are arranged on the exterior of the mobile units, i.e., on their roof structures, for supporting each of the roofs of each of the mobile units 702, 706 and 708 along their length, in the absence of one inner side wall for each of mobile units 702 and 708 and both side walls for the "interior" mobile unit 706. In this example, the mobile unit 702 has truss structures 702*a* and 702*b*, the mobile unit 706 has truss structures 706*a* and 706*b* and the mobile unit 708 has trust structures 708*a* and 708*b*.

Each of the trusses 702*a*, 702*b*, 706*a*, 706*b*, 708*a* and 708*b* can extend along a certain longitudinal portion of the roof structure of the each of the respective mobile units. The longitudinal extents of these trusses are selected to cover the longitudinal extent of an open side wall that is generally beneath the trusses plus an extra portion on either side so that they provide enough strength for the roof structures of the mobile units. Accordingly, each truss is responsible for supporting the roof structure along a portion that, were an internal side wall present, would be supported by the side wall. In this example, the trusses extend along substantially the entire longitudinal length of the mobile units 702, 706 and 708 but in some cases, they can be shorter than the length of the mobile unit.

The amount of support that a truss can provide to a portion of a roof structure is related to the size of the and strength of the truss. Accordingly, for embodiments in which the trusses are made larger, it will be sufficient to only have one truss along near seam where two mobile units are adjacent to one another when assembled (this is not shown in the figures).

However, using large trusses may make it difficult to transport the mobile units to an installation site since the mobile units may be typically transported on flatbed trucks or flatbed trailers and there may be a height restriction when such vehicles have to pass under a bridge. Also, larger trusses may pose challenges at certain installation sites where the height of the mobile unit including the trusses may be limited.

Advantageously, in accordance with one aspect of the teachings herein, by utilizing two smaller trusses instead of a single larger truss near the edges of the roof structures of adjacent mobile units, the structural integrity and strength of a single larger truss is retained but the smaller trusses make it easier to transport the mobile units and install the mobile units at sites where vertical real-estate is limited. As such, in at least one embodiment described herein, two trusses supporting the roof structures of adjacent mobile units are themselves placed adjacent to each other and coupled together.

In this example embodiment, each truss 702*a* to 708*b* may be 19 inches tall, although alternative sizes are possible depending on the size of the mobile units 702, 706 and 708 and the strength requirements which is based on the extent of the missing side walls within the compound structure 700. In this example embodiment, each truss 702*a* to 708*b* is affixed to an end portion of the roof structure of each mobile unit, with welding or rivets or other fastening mechanisms such as nuts/bolts combinations and is affixed at many points along the extent of the roof structures that they span in a similar manner thereby to support the roof from above. Respective gaskets may be positioned between facing peripheries of the mobile units that face each other.

FIG. 11C is an end transverse cross-sectional view of the array/arrangement of three mobile units 702, 706 of FIG. 11B, showing the width of a larger room 700*i* having been formed using the interiors of the three mobile units 702, 706 and 708. As can be seen the floor structures 703, 705 and 707 of the mobile units 702, 706 and 708 have been leveled. This leveling may be done by connecting the lower corner castings of adjacent mobile units 702, 706 and 708 to one another such as connections 710 and 712. In alternative embodiments, bridge plates, seal membranes and/or insulation may be disposed at the portions of the floor structures of adjacent mobile units that face one another. In addition, the arrangement of mobile units 702, 706 and 708 may be placed on a level structure that can be provided by various means including various beams, such as I-beams that can be placed on blocks and/or on helical piles that are inserted into the ground deep enough to provide structural stability.

Figure 12C:
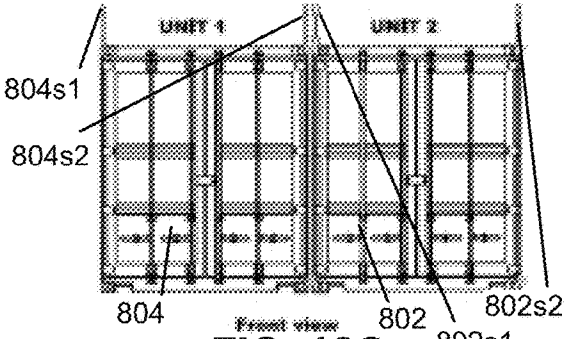
FIGS. 12C-12E show a first end view, a transverse cross-sectional view, and a second end view of the assembly of mobile units of FIG. 12A.
Figure 12D:
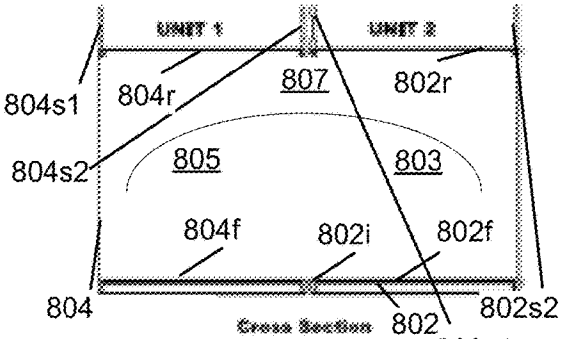
Figure 12E:
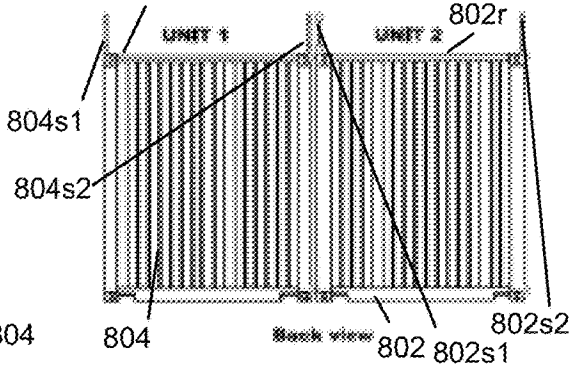
Figure 12A:
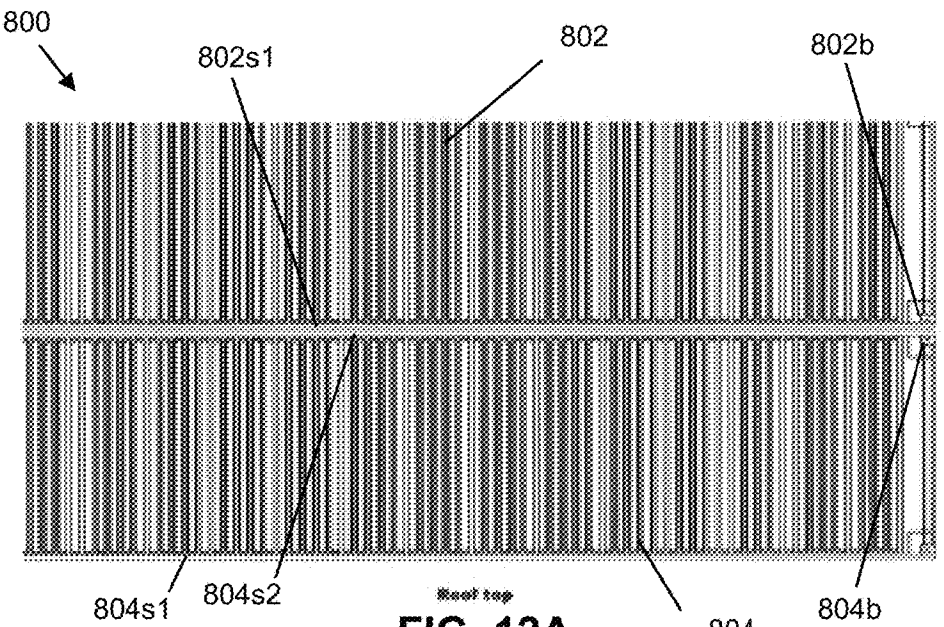
FIG. 12A shows a top view of an example embodiment of an array of two mobile units that are assembled laterally, or horizontally offset, to one another and sealingly interconnected to form a single large interior room and having respective roof trusses for supporting their respective roofs in the absence of interior support walls or other interior support structures.

Various combinations of mobile units may be assembled to create various types of compound modular structures. For example, FIG. 12A is a top view of a compound structure 800 that includes an array of two mobile units that are sealingly interconnected to form a single large interior room. In this example, the compound structure 800 comprises a first mobile unit 802 and a second mobile unit 804. The first mobile unit 802 includes a first floor structure 802*f*, a first roof structure 802*r*, and at least one first side wall that is coupled to the floor structure 802*f* and the roof structure 802*r* to define a first open side for the first mobile unit 800. The second mobile unit 804 includes a second floor structure 804*f*, a second roof structure 804*r*, and at least one second side wall that is coupled to the floor structure 804*f* and the roof structure 804*r* to define a second open side for the second mobile unit 804. The compound structure 800 also includes a support structure that is adapted to couple the first and second roof structures 802*r* and 804*r* together to releasably connect the first and second mobile units 802 and 804 so that the first open side of the first mobile unit 802 faces the second open side of the second mobile unit 804 when the first and second mobile units 802 and 804 are assembled adjacent to one another in the compound structure 800.

The support structure may be a roof support structure that is connected to the roof structure 802*r*, 804*r* or at least one of the first or second mobile units 802 and 804. For instance, in the example embodiment shown in FIGS. 12A-12E, the support structure may be a combination of two roof trusses where one roof truss 802*s*1 is attached to the first mobile unit 802 and a second roof truss 804*s*2 is attached to the second mobile unit 804. The attachment of each truss 802*s*1 and 804*s*2 to its respective roof structure 802*r* and 804*r* may be done through various techniques such as through forming a seal weld. In some cases, the trusses can be welded along their entire length to the respective roof structure that they are attached to. The weld seal can be used to protect the interior of the compound structure from external weather. In some cases, for the various embodiments described herein there may be side plates that are used to connect a truss to its respective roof structure.

When the first and second mobile units 802 and 804 are brought together for assembly, the first and second roof trusses 802*s*1 and 804*s*2 can be releasably coupled to one another using appropriate fasteners such as bolts and/or brackets. Accordingly, if the compound structure is disassembled the trusses can be disconnected more readily. As more readily seen in FIG. 12D, the roof trusses 802*s*1 and 804*s*2 are located along edges of the respective mobile units 802 and 804 for supporting the respective roof structures in the absence of side walls.

Figure 12B:
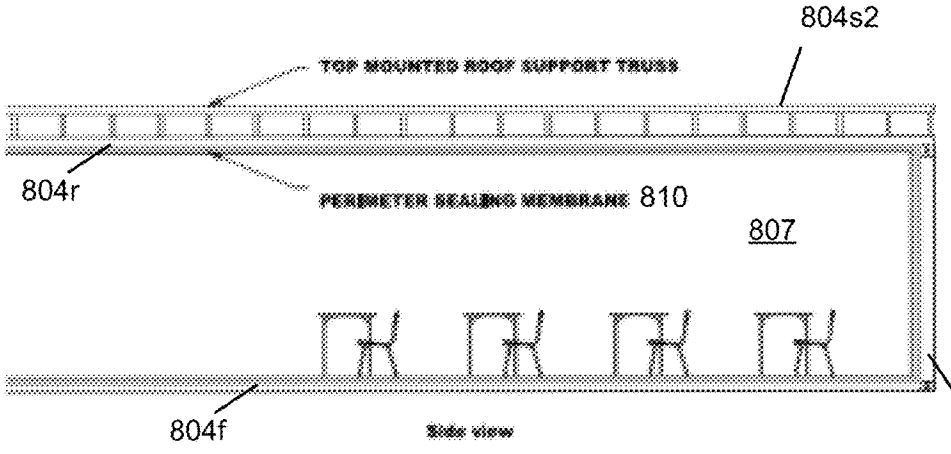
FIG. 12B shows a side or longitudinal cross-sectional view of the assembly of mobile units of FIG. 12A, showing classroom desks in a single large room, roof trusses, and a sealing membrane gasket along the interface between the roofs of two adjacent two mobile units.

Each of the mobile units 802 and 804 have a side wall and two end walls and are somewhat a mirror image of one another thereby to encompass a larger interior room 807 that is formed from the combination of the interior rooms 803 and 805 of the mobile units 802 and 804. FIG. 12B is a side cutaway view (longitudinal cross-sectional view) of the array/assembly of mobile units taken between the trusses 804*s*2 and 802*s*1, showing classroom desks in the single large room 807, the roof truss 804*s*2, and a perimeter sealing membrane/gasket 810 that extends around the periphery of the interface between the two mobile units 802 and 804.

It should be noted that trusses that are located along a longitudinal edge of a mobile unit may be referred to as an edge truss. Trusses 802*s*1, 802*s*2, 804*s*1 and 804*s*2 are all examples of edge trusses. In other embodiments, there may be additional trusses (not shown) that might be added between the edge trusses. These additional trusses may be equally spaced and referred to as inner trusses, for example, and may be used when additional support is needed for one or more of the roof structures of a compound structure. These additional trusses may also be used in situations where it is desirable to have even smaller trusses that are disposed along the outer surface of the roof structure of one or more mobile units in order to reduce any headspace that is needed for the trusses while still providing the needed structural support.

Figure 13A:
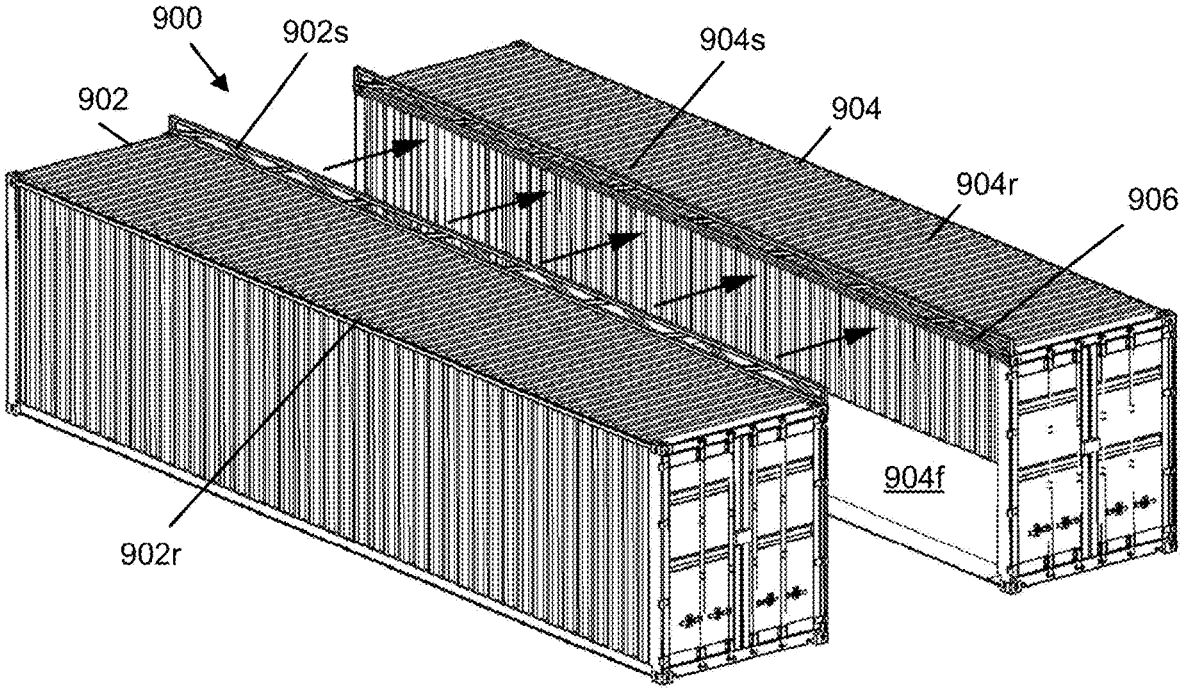
FIG. 13A shows a perspective view of another example embodiment of mobile units that are adapted for assembly to form a compound structure.

Referring now to FIG. 13A, shown therein is a perspective view of another example embodiment of a compound structure 900 that is formed from mobile units 902 and 904 that are adapted for assembly with one another and disassembly. The mobile unit 902 includes a roof structure 902*r*, a floor structure 902*f*, a truss 902*s* and an open side wall. The mobile unit 904 includes a roof structure 904*r*, a floor structure 904*f*, a truss 904*s* and an open side wall. As shown in FIG. 13A, the two mobile units 902 and 904 are brought together and there is a sealing member 906 that can be disposed on the portion of a ceiling longitudinal edge of one of the mobile units (in this case mobile unit 904) which is then compressed when the two mobile units 902 and 904 are joined. This may be through clamping the upper and lower corner castings of each mobile unit 902 and 904 together. The sealing member 906 may be a closed-cell foam which can function as was described for the embodiment shown in FIG. 8B.

Figure 13B:
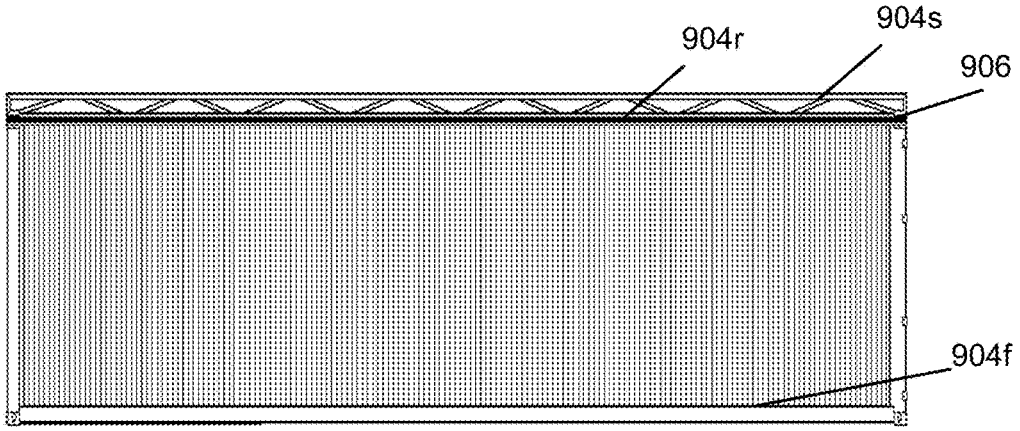
FIGS. 13B and 13C show a longitudinal cross-sectional side view and transverse cross-sectional view, respectively, of the mobile units of FIG. 13A after assembly.
Figure 13C:
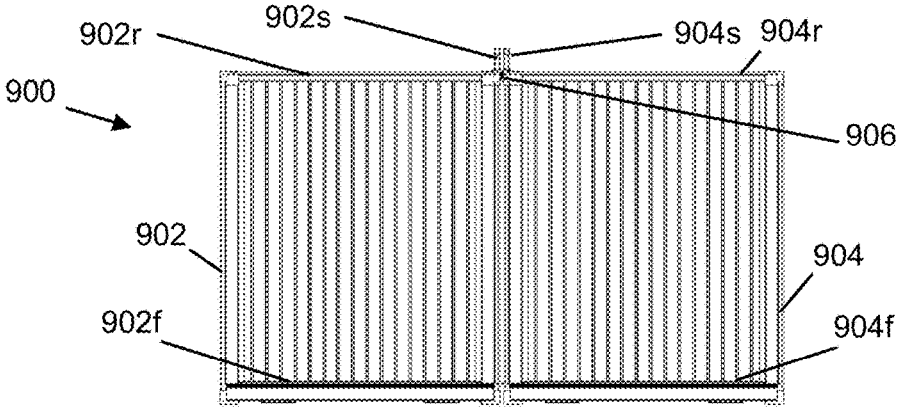

FIGS. 13B and 13C show a longitudinal cross-sectional side view and transverse cross-sectional view, respectively, of the mobile units 902 and 904 when they are assembled together. As was described for a previous embodiment, alternatively the support structure can be attached along a longitudinal portion of an exterior of one of the first and second mobile units 902 and 904 when the support structure is a single truss, or the support structure can be attached along a longitudinal portion of an exterior of both of the first and second mobile units 902 and 904 when the support structure includes two trusses as is shown in this example. In this case, the support structure involves attaching the two trusses 902*s* and 904*s* along a portion of the first and second roof structures 902*r* and 904*r*, respectively, that are adjacent to one another when the first and second mobile units 902 and 904 are assembled adjacent to one another in the compound structure 900.

Figure 13D:
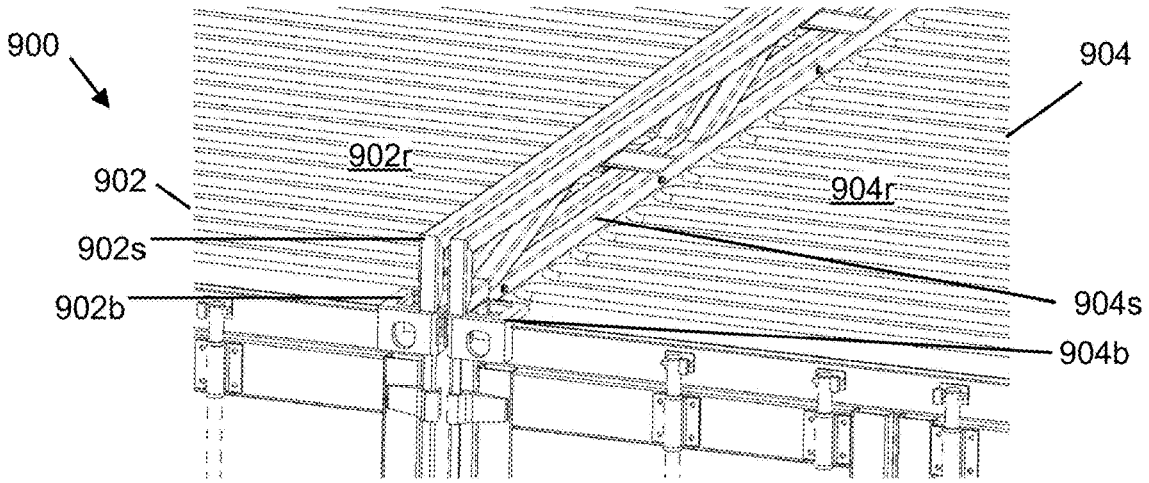
FIG. 13D-13E show an enlarged perspective end view and an enlarged perspective transverse cross-sectional view of the mobile units of FIG. 13A after assembly.
Figure 13E:
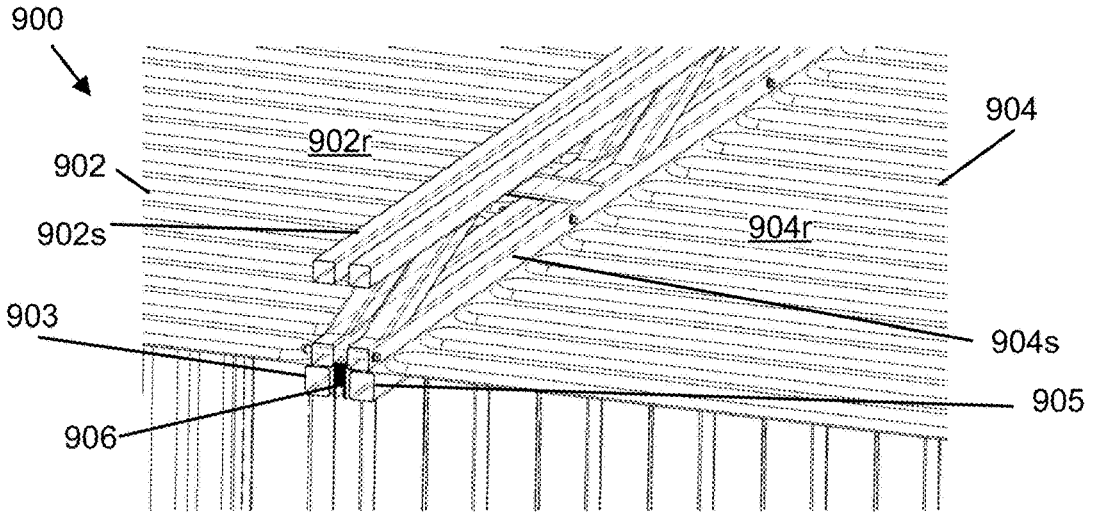

Referring now to FIGS. 13D-13E, shown therein is an enlarged perspective end view and an enlarged perspective transverse cross-sectional view, respectively, of the mobile units 902 and 904 after assembly. As can be seen the trusses 902*s* and 904*s* can each be individually riveted, bolted and/or welded to their respective roof structures 902*r* and 904*r*. These trusses 902*s* and 904*s* may also be attached to longitudinal bars or frame members 903 and 905 that extend along the length of the mobile units 902 and 904 along an inner surface of the roof structures 902*r* and 904*r*, respectively. The trusses 902*s* and 904*s* may also be connected to one another through bolts or plates (both not shown) thereby compressing a seal member 906 therebetween so that no liquid, snow or other external elements can pass through the roof structure into the interior of the compound structure 900.

Figure 14:
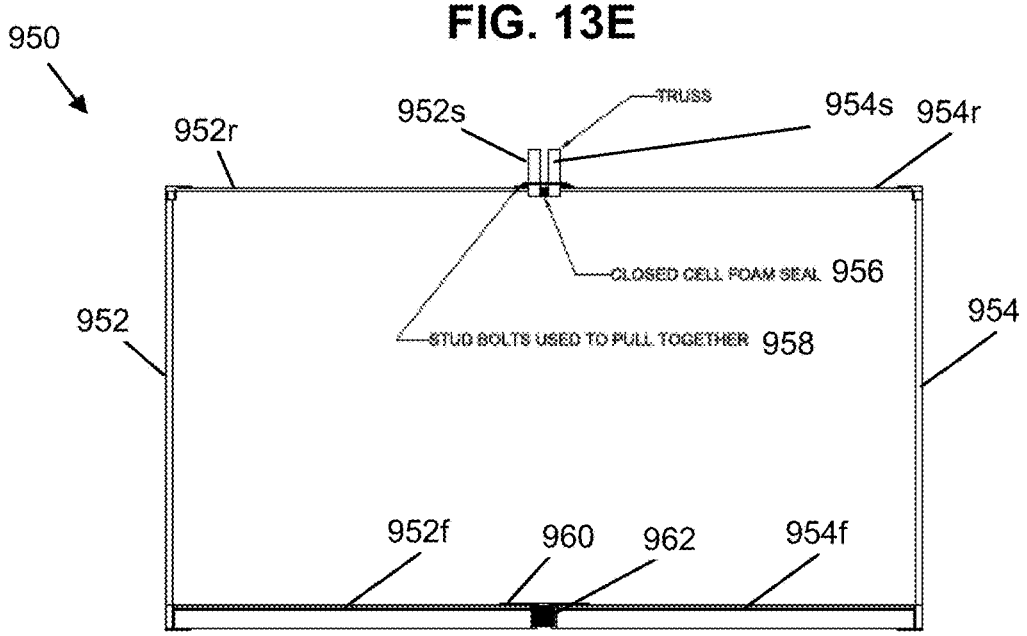
FIG. 14 shows a cross-sectional view of another example embodiment of an assembly of mobile units to form a compound structure.

Referring now to FIG. 14, shown therein is a cross-sectional view of another example embodiment of an assembly of mobile units 952 and 954 that together form a compound structure 950. In this example embodiment, the support structure extends along a longitudinal portion of an exterior of the roof structures 952*r* and 954*r*. Similar to the compound structure 900, the support structure comprises separate trusses that are attached to their respective roof structures. In this case, the portion of the trusses 952*s* and 954*s* that are closer to the exterior surface of the roof structures 952*r* and 954*r* are coupled to one another using fasteners such as bolts (like stud bolts) and optionally plates that also aid in pulling together the mobile units 952 and 954 to compress a seal 956 at the interface between the adjacent roof structures 952*r* and 954*r*. The seal 956 may be made using closed cell foam. Also, included are bridge plates 960 that are screwed or bolted onto end portions of the floor structures 952*f* and 954*f* of the mobile units 952 and 954 along a longitudinal extent of the mobile units 952 and 954. There may be several bridge plates 960 that are arranged in an end-to-end fashion along the longitudinal extent of the mobile units 952 and 954. The bridge plates 960 may aid in aligning the floor structures of the two mobile units 952 and 954 in some cases. The bridge plates 960 also function to prevent anything from entering into the compound enclosure from beneath the floor structures 952*f* and 954*f*. Insulation region 962 can also be located at the interface between the floor structures 952*f* and 954*f* of the mobile units 952 and 954 to, for example, keep the interior of the compound structure 950 cool or warm with respect to the external elements. The insulation region 962 may be any suitable insulation such as spray foam, for example, that can provide a desired level thermal insulation.

Figure 15A:
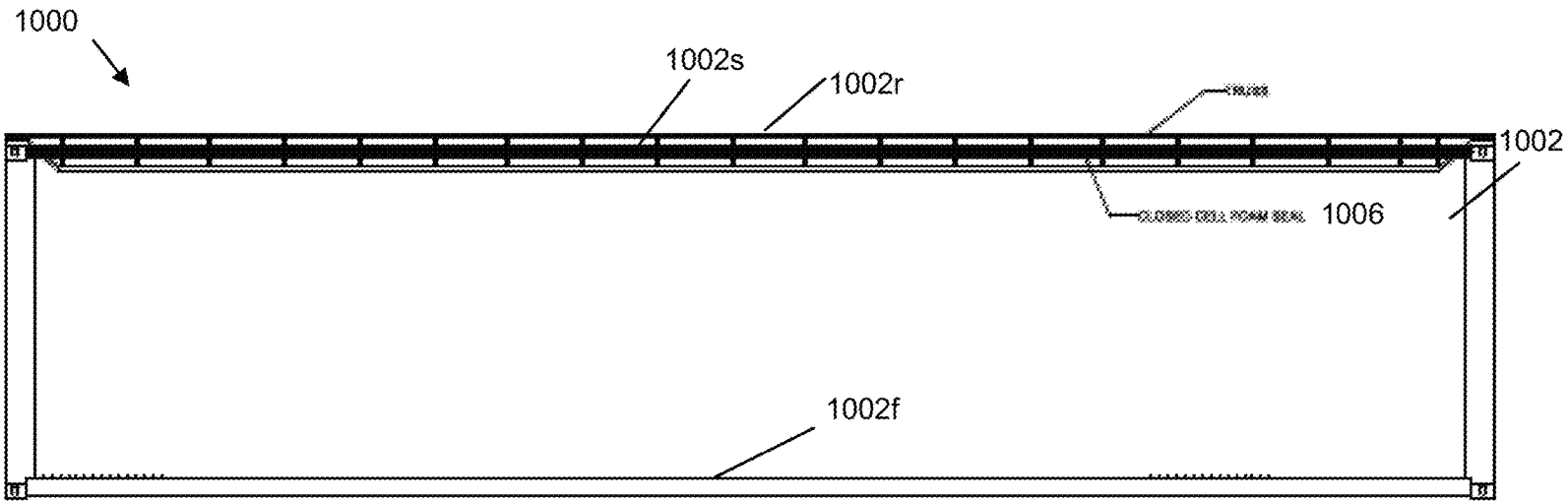
FIGS. 15A-15C show a side longitudinal cross-sectional view, a transverse cross-sectional view and an enlarged cross-sectional view of another example embodiment of an assembly of mobile units to form a compound structure.
Figure 15C:
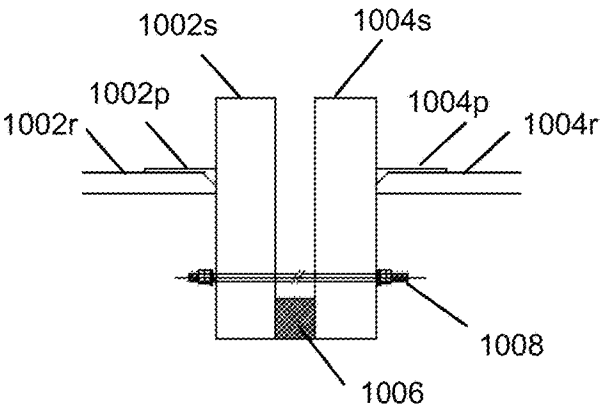
Figure 15B:
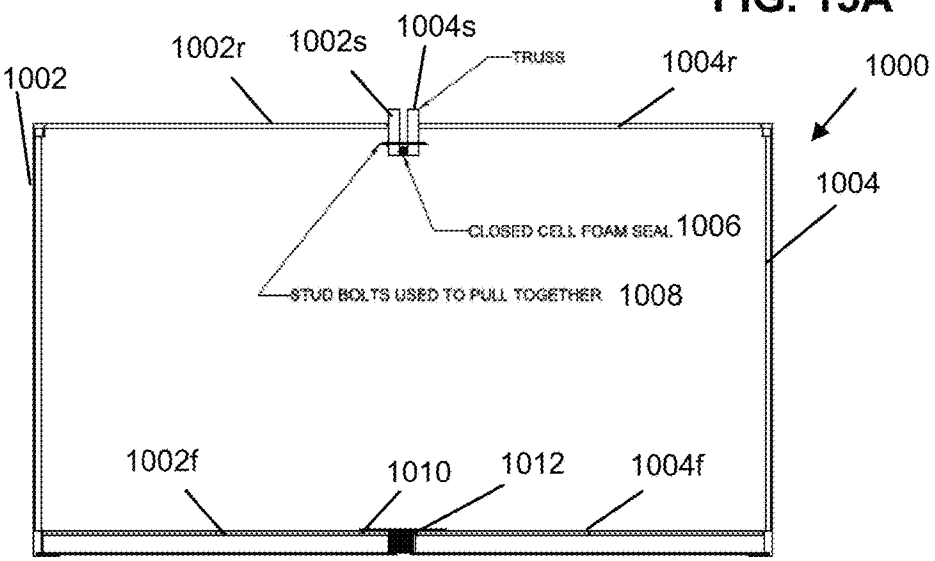

Referring now to FIGS. 15A-15C, shown therein are side longitudinal cross-sectional, transverse cross-sectional and enlarged cross-sectional views of another example embodiment of an assembly of mobile units 1002 and 1004 that together form a compound structure 1000. The compound structure 1000 is similar to the compound structure 950 in that the mobile unit 1002 includes a roof structure 1002*r*, a floor structure 1002*f*, an internal open side and a truss 1002*s* while the mobile unit 1004 includes a roof structure 1004*r*, a floor structure 1004*f*, an internal open side and a truss 1004*s* where the trusses 1002*s* and 1004*s* are attached to their respective roof structures 1002*r* and 1004*r* as well as each other and there are also bridge plates 1010, insulation region 1012 and a seal 1006 as was described from the compound structure 950.

However, for the compound structure 1000, the support structure can include a single truss (not shown) attached to one of the mobile units 1102 and 1104 or the support structure can include trusses 1102*s* and 1104*s* (as shown). In such embodiments, it can be said then that the support structure is attached along a longitudinal portion to the roof structure of at least one of the first and second mobile units 1002 and 1004 so that an upper portion of the support structure extends along an exterior of the roof structure of at least one of the first and second mobile units 1002 and 1004 and a second portion of the support structure extends along a longitudinal portion of an interior portion of at least one of the first and second mobile units 1002 and 1004. For example, interior portion of at least one of the first and second mobile units 1002 and 104 in these cases is a longitudinal portion of the ceiling structure of at least one of the first and second mobile units 1002 and 1004.

Figure 16:
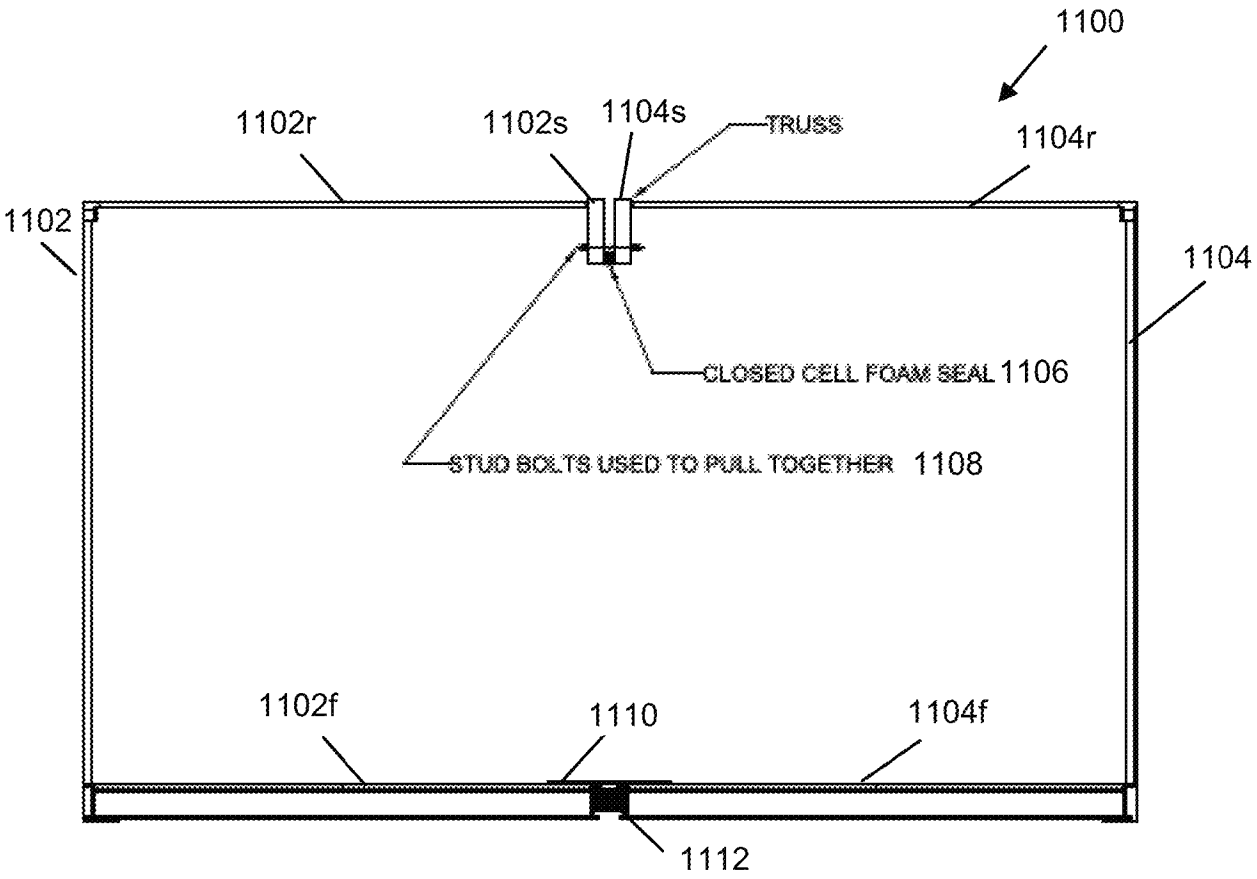
FIG. 16 shows a transverse cross-sectional view of another example embodiment of an assembly of mobile units to form a compound structure.

Referring now to FIG. 16, shown therein is a transverse cross-sectional view of another example embodiment of an assembly of mobile units 1102 and 1104 that together form a compound structure 1100. The compound structure 1100 is similar to the compound structures 950 and 1000 in that the mobile unit 1102 includes a roof structure 1102*r*, a floor structure 1102*f*, an internal open side and a truss 1102*s* while the mobile unit 1104 includes a roof structure 1104*r*, a floor structure 1104*f*, an internal open side and a truss 1104*s* where the trusses 1102*s* and 1104*s* are attached to their respective roof structures 1102*r* and 1104*r* as well as each other and there are also bridge plates 1110, insulation region 1112 and a seal 1106 as was described from the compound structures 950 and 1000. However, for the compound structure 1100 the support structure may include a single truss (not shown) or the trusses 1102*r* and 1104*r* that are attached along a longitudinal portion of an interior portion of the first and second mobile units 1102 and 1004.

In the compound structures described herein, where larger rooms are formed generally for containing larger numbers of people, air quality and thus air exchange may continue to be important. Various configurations of HVAC and HEPA air conditioning and filtering such as the various configurations described herein can be deployed in the compound structures. For example, a single two-ton HVAC system may be successfully deployed in a compound structure consisting of three mobile units. In such cases, mobile units having an HVAC system such as those described with respect to FIGS. 1 to 7B, may be incorporated into the compound structure to provide the desired air quality and air exchange. The number of such mobile units that are included in such a compound modular structure depend on the size of the interior of the structure and the number of air exchanges that are required. If more than one HVAC unit is needed, then the mobile units at the two side portions of the compound modular structure can incorporate an HVAC unit as is shown in the example embodiment of FIGS. 10A and 10B. For even larger structures, which may need more than two HVAC units, mobile units having such HVAC units can be interspersed between other mobile units that do not have an HVAC unit. For example, for a modular enclosure that has 5 mobile units that are laterally arranged with one another, the first, third and last mobile units can have an HVAC unit while the second and fourth mobile unit do not have an HVAC unit.

It will be appreciated that a mobile unit for use within a compound structure such as those shown in FIGS. 10A through 16 may have only two or three full walls, but a fourth part-wall. In this way, a larger room can be formed that has part divisions. For example, a fourth part-wall might extend a quarter, a third, a fourth or another portion of the way along the longitudinal span of the mobile unit, thereby to provide part division within the larger room and provide partial support for the roof. It will be appreciated that while a part-wall may serve part of a roof support function, a truss or other roof support structure can still be used to accommodate for the span that is not so supported, rather than the full span. Various combinations of trusses of various lengths and partial walls of various lengths are possible in various compound structures that are assembled according to any of the teachings herein.

In various embodiments, compound structures may be made using mobile units where all of the mobile units are made from shipping containers, all of the mobile units are made from custom enclosures or some of the mobile units are made from shipping containers while other mobile units are made from custom enclosures.

It should be noted that in the various embodiments described herein it may be possible that some of the trusses do not have to span the entire length of the mobile unit. For example, if an open side wall portion is 30% of the length of a mobile unit, then a truss may be attached that is 50% of the length of the mobile unit and covers the open side wall portion.

In various embodiments that incorporate bridge plates along the adjacent portions of the floor structures of adjacent mobile units, the bridge plates may be made using metal plates, stainless steel, aluminum or another suitable material. The bridge plates may be screwed own on either side of the longitudinal seam between the adjacent floor structures of the adjacent mobile units.

In various embodiments that incorporate insulation regions below the bridge plates, the insulation regions may be made using an insulation membrane which can be foam or another type of insulation.

For example, it has been found that interior walls that are formed from powder-coated, marine grade aluminum panels, or high gloss powder coated aluminum, provide excellent surfaces for writing using, for example, dry erase markers. These materials also provide corrosion resistance and can tolerate even constant contact with seawater. As such, mobile units such as those shown in FIGS. 10A to 16, when provided with interior panels as described herein, provide ample space for student whiteboards. In addition, in at least one embodiment, depending on the particular use of the mobile units, additional coating or sealant may be applied as needed, such as for example, sealant or medical grade silicone sealant which may be applied along the interfaces between wall panels and/or ceiling panels to provide mold-resistant sealing. For example, the interior walls, coating and/or sealing can be implemented in accordance with the teachings of PCT patent application No. PCT/CA2021/051031 filed on Jul. 23, 2021.

In the various example embodiments disclosed herein, the mobile units and the other modules usable for forming compound structures of various configurations, are fully insulated to provide reliable operation within temperatures ranging from −50° C. (−58° F.) to about 50° C. (122° F.), and a constructed with fire-resistant construction techniques and materials.

It should be noted that in the various embodiments described herein where shipping containers are being used as mobile units or portions of a compound structure, the various modules and units are built to meet standards and regulations when using the mobile units for certain purposes such as medical or educational while occupying a more constrained physical space (i.e., a shipping container). Since the shipping containers include metal walls and metal roofs and these units need to be mobile, which may involve transport using a flatbed truck or a tractor trailer that travels on rough surfaces (e.g., bumpy country or city roads), different construction techniques are used compared to those which would be used in a conventional medical setting in a building.

For example, certain components are constructed to have increased rigidity which may include the various ducts that are used by the airflow systems. These ducts have seams that are sealed using a more durable sealant, such as concrete sealing, that is able to withstand shocks that are experienced during transportation of the medical unit. The duct work that is used is therefore rigid. This is in contrast to the duct work used in medical buildings where the duct seams may be sealed with duct tape.

As another example the metal housing of the shipping container including the roof and/or the outer walls as well as optionally the rigid wall panels described herein may be used for suspending certain medical or airflow system components, such as the HVAC system, which allows these components to be distributed around the shipping container freeing up more space in the shipping container for the rooms contained therein. For example, marine grad materials may be used for certain wall panels, ceiling components and housing of the shipping container which provides additional structural integrity for the various modules/units described herein.

In the various embodiments described herein, the containers that are used to make the various units can be other types of suitable shipping/storage containers including double-door containers, for example.

Furthermore, while various examples of mobile modules have been described and depicted above, other kinds of mobile modules may be incorporated into a compound structure or used in isolation on a site, including washroom module(s), pharmacy module(s), laboratory module(s), morgue module(s), step down or simple isolation module(s), clean room module(s), utility room module(s), module(s) to house medical gas(es) along with suction and power, and other kinds of modules.

In addition, while particular lengths and formats of shipping containers have been described and depicted herein, it will be understood that the principles described herein are applicable to modules having different dimensions, whether using a shipping container as a base, or whether being custom fabricated and also whether such modules are portable or stationary. Furthermore, there may be embodiments in which different structures may be used rather than shipping containers.

In at least one embodiment described herein, the portable unit 100 or other rooms, and the other modules which may be used with the portable unit 100 for forming portable, semi-permanent, or permanent compound structures of various configurations, may be constructed using fire-resistant construction techniques and materials. For example, the exterior and interior walls and the roof panels of the units and structures described herein may be coated with a fire-retardant spray to prevent damage to the interior of the unit. Alternatively, in at least one example, materials may be used that inherently have fire retardant properties.

Furthermore, while embodiments of compound structures described and depicted herein are single-level structures, alternatives are possible. For example, a compound structure may be assembled by vertically stacking at least two modules and facilitating entry and exit, maintenance and the like, on second, third etc. levels. This may involve using mobile units that can support the weight of one another, or multiple, mobile units and that do not feature additional components such as the HVAC equipment for mobile units on the second or higher levels.

In addition, while particular airflow systems have been described and depicted, alternatives are possible that include more or fewer components. For example, ultraviolet (UV) light air cleaners may be placed in the airflow systems, and in particular in the return duct airstream. The UV lights will obstruct airflow somewhat, but the obstruction will not unduly affect providing airflow at proper and safe levels.

In one aspect, in accordance with the teachings herein, there is provided at least one embodiment of a mobile unit having an interior defined by fewer than four side walls, the mobile unit being adapted to be interconnected with at least one like or different mobile unit, the at least one like or different mobile unit having fewer than four side walls, thereby to jointly form a large interior room.

In at least one embodiment, the mobile unit has two walls thereby to interface with two different mobile units thereby to jointly form the large interior room.

In at least one embodiment, the mobile unit has three walls thereby to interface with at least one other different mobile unit to jointly form the large interior room.

In another aspect, in accordance with the teachings herein, there is provided a compound structure incorporating at least one mobile unit that is defined in accordance with the teaching herein and at least one different mobile unit that is defined in accordance with the teachings herein.

In at least one embodiment, the compound structure further comprises a roof support structure associated with at least a roof of the mobile unit.

In at least one embodiment, the roof support structure is a truss.

In at least one embodiment, the truss is associated with the outside of the roof.

In at least one embodiment, the compound structure further comprises at least one sealing gasket between at least one pair of adjacent connected mobile units.

While the applicant's teachings described herein are in conjunction with various embodiments for illustrative purposes, it is not intended that the applicant's teachings be limited to such embodiments as the embodiments described herein are intended to be examples. On the contrary, the applicant's teachings described and illustrated herein encompass various alternatives, modifications, and equivalents, without departing from the embodiments described herein, the general scope of which is defined in the appended claims.

The invention claimed is:

1. A compound structure comprising:

a first mobile unit including:
- a first floor structure;
- a first roof structure;
- at least one first side wall that is coupled to the floor structure and the roof structure to define a first open side for the first mobile unit;

a second mobile unit including:
- a second floor structure;
- a second roof structure;
- at least one second side wall that is coupled to the floor structure and the roof structure to define a second open side for the second mobile unit;

a support truss extending the full longitudinal extent of the first open side, the second open side or both the first and second open side, the support truss being adapted to couple the first and second roof structures together to releasably connect the first and second mobile units so that the first open side of the first mobile unit faces the second open side of the second mobile unit when the first and second mobile units are assembled adjacent to one another in the compound structure;

one or more bridge plates installed to cover longitudinal edge portions of the first and second floor structures adjacent to one another;

a compressible seal between the first mobile unit and second mobile unit; and at least one clamp for urging the first mobile unit and second mobile unit together and compressing the compressible seal between the first and second mobile units, the at least one clamp coupled to a corner block of the first mobile unit and a corner block of the second mobile unit.

2. The compound structure of claim 1, wherein the support truss is a roof support that is also connected to the roof structure of at least one of the first or second mobile unit.

3. The compound structure of claim 1, wherein the support truss is attached along a longitudinal portion of an exterior of at least one of the first and second mobile units.

4. The compound structure of claim 1, wherein the support truss is attached along a longitudinal portion of an interior portion of the at least one of the first and second mobile units.

5. The compound structure of claim 1, wherein the support truss is also attached along a longitudinal portion to the roof structure of at least one of the first and second mobile units so that an upper portion of the support truss extends along an exterior of the roof structure of at least one of the first and second mobile units and a second portion of the support truss extends along a longitudinal portion of an interior portion of at least one of the first and second mobile units.

6. The compound structure of claim 1, wherein the support truss is attached along a portion of the first and second roof structures that are adjacent to one another when the first and second mobile units are assembled adjacent to one another in the compound structure.

7. The compound structure of claim 1, wherein the support truss extends along a substantial portion of the longitudinal extent of the first and second mobile units.

8. The compound structure of claim 1, wherein the first and second open sides extend along only a section of the longitudinal extent of the first and second mobile units.

9. The compound structure of claim 1, wherein the support truss comprises a first truss and a second truss that are releasably coupled to one another where the first truss is attached to the first mobile unit and the second truss is attached to the second mobile unit.

10. The compound structure of claim 1, wherein a given mobile unit comprises two or more support trusses that are attached along a longitudinal extent of the given mobile unit.

11. The compound structure of claim 10, wherein the support truss comprises two edge trusses that are located along opposite longitudinal edges of the given mobile unit.

12. The compound structure of claim 11, wherein the given mobile unit comprises two opposing open sides that are located along portions of the longitudinal extent the given mobile unit.

13. The compound structure of claim 11, wherein the support truss comprises additional trusses that extend longitudinally and are arranged between the two edge trusses.

14. The compound structure of claim 1, wherein the seal comprises a gasket, neoprene rubber foam, a closed cell foam or a combination of neoprene rubber foam and a closed cell foam.

15. The compound structure of claim 1, further comprising an insulation region that is below the one or more bridge plates and between longitudinal edge portions of the first and second floor structures.

16. The compound structure of claim 1, wherein at least one of the mobile units includes an air flow system for providing conditioned air into the compound structure, where the air flow system is at least partially located in a maintenance room at one or both ends of the at least one mobile unit.

17. The compound structure of claim 1, wherein at least one of the mobile units is made from a shipping container or a custom enclosure.

18. The compound structure of claim 1, wherein the compound structure is used as an educational structure including a classroom and/or a portable, a military structure, a correctional facility, a penitentiary structure, a testing and vaccination centre, a quarantine facility, a modular laboratory structure, a cleanroom, a long-term care facility, a natural disaster safe shelter, an indigenous community housing structure, a vertical farming structure, a grow room, a mobile restaurant, a mobile bar, a cottage, a retail structure, a mining structure, a modular housing structure, a social housing structure, a remote community structure, healthcare facilities, medical clinics, or infrastructure for hospitals.

19. The compound structure of claim 1, wherein the compressible seal is reusable.

* * * * *